US006775956B1

(12) United States Patent
Lacey

(10) Patent No.: US 6,775,956 B1
(45) Date of Patent: Aug. 17, 2004

(54) WRAPPING METHOD AND APPARATUS

(76) Inventor: Liam J. Lacey, The Moorings, Merrion Road, Ballsbridge, Dublin 4 (IE)

( * ) Notice: Subject to any disclaimer, the term of this patent is extended or adjusted under 35 U.S.C. 154(b) by 115 days.

(21) Appl. No.: 10/070,514

(22) PCT Filed: Sep. 8, 2000

(86) PCT No.: PCT/IE00/00104

§ 371 (c)(1),
(2), (4) Date: Mar. 5, 2002

(87) PCT Pub. No.: WO01/17854

PCT Pub. Date: Mar. 15, 2001

(30) Foreign Application Priority Data

Sep. 9, 1999 (IE) ..... S990763

(51) Int. Cl.[7] ..... B65B 11/58

(52) U.S. Cl. ..... 53/399; 53/445; 53/449; 53/156; 53/176; 53/587; 53/588

(58) Field of Search ..... 53/399, 441, 445, 53/449, 587, 588, 556, 176, 154–157, 139.5–139.7; 100/1–3

(56) References Cited

U.S. PATENT DOCUMENTS

| | | | | |
|---|---|---|---|---|
| 2,664,813 A | * | 1/1954 | Rose | 100/2 |
| 2,677,323 A | * | 5/1954 | O'Konski | 100/3 |
| 2,828,031 A | | 3/1958 | Babcock et al. | |

(List continued on next page.)

FOREIGN PATENT DOCUMENTS

| | | | | |
|---|---|---|---|---|
| DE | 3834535 | | 3/1990 | |
| DE | 40 160 424 | | 11/1991 | |
| DE | 40 37 533 | | 5/1992 | |
| EP | 0 691 914 B1 | | 4/1999 | |
| JP | 02282020 A | * | 11/1990 | ..... B65B/27/08 |
| WO | WO 94/01997 | | 2/1994 | |
| WO | WO 94/02358 | * | 2/1994 | ..... B65B/51/08 |
| WO | WO 99/04613 | | 2/1999 | |

OTHER PUBLICATIONS

Brochure by Mollers entitled: "Palletless Despatch Units Reverse Hood Shrinkage Wrapping System," Apr. 2002.
Copy of *Notice of References Cited* from U.S. patent application Ser. No. 09/994,854, 1 page.

*Primary Examiner*—Stephen F. Gerrity
(74) *Attorney, Agent, or Firm*—Kusner & Jaffe

(57) ABSTRACT

A method and apparatus for wrapping loads of goods and materials in a wrapping material such as a plastics film, including placing at least two battens in a spaced substantially parallel orientation on one surface of the load using a pick and place unit, partially wrapping the load with the wrapping material by rotating the load relative to a dispenser for the wrapping material and/or rotating the dispenser around the load, at a first wrapping station, to envelop the battens in the wrapping material and to hold the battens in place on the surface of the load, the battens being spaced apart to support the load and being adapted to receive therebetween the forks of a fork-lift truck for transporting the load. Preferably, the wrapping material overlaps the ends of the battens to hold the battens in position. The load is then turned through about 90° from the first wrapping station to a second wrapping station where the wrapping is completed.

26 Claims, 32 Drawing Sheets

U.S. PATENT DOCUMENTS 2,943,558 A * 7/1960 Hall et al. ..... 100/2
3,568,393 A * 3/1971 King et al. ..... 53/399
3,783,773 A * 1/1974 Willard et al. ..... 100/3
3,805,473 A * 4/1974 Lidgard ..... 53/397
4,000,815 A * 1/1977 Wingbro et al. ..... 206/205
4,060,957 A * 12/1977 Birkenfeld et al. ..... 53/449
4,524,685 A 6/1985 Bergmann
4,546,593 A 10/1985 Lasscock
4,593,517 A 6/1986 Mattila
4,607,476 A 8/1986 Fulton, Jr.
4,641,484 A 2/1987 Popelka
4,730,732 A * 3/1988 Wagonseller ..... 206/597
4,897,980 A * 2/1990 Geyser et al. ..... 53/397
4,942,719 A 7/1990 Fleissner
5,125,210 A 6/1992 Lang et al.
5,664,933 A 9/1997 Scherer et al.
5,720,153 A 2/1998 Martin-Cocher
5,740,662 A 4/1998 Royneberg et al.
5,802,805 A 9/1998 Oiestad
6,082,076 A 7/2000 Anderson et al.
6,341,470 B1 1/2002 Lacey

* cited by examiner

WRAPPING METHOD AND APPARATUS

FIELD OF THE INVENTION

The invention relates to a method and apparatus for wrapping loads of goods and materials in a wrapping material including an internal support means to assist in transporting the loads. The invention provides an alternative to a conventional pallet but serves the same purpose of supporting and transporting loads.

BACKGROUND OF THE INVENTION

Pallets are commonly used for transporting and storing goods and materials. Pallets typically comprise a portable wooden platform on which the load is carried. The platform usually comprises two parallel planar surfaces spaced apart by transverse wooden battens to form channels intended to receive the forks of a fork-lift truck. Typically the load is built-up on the wooden platform and the whole load may then be cling-wrapped or heat-shrunk in a suitable plastics wrapping material.

The use of conventional wooden pallets represents a high element in the cost of transport and storage, and there is a further significant hidden cost in the logistics of pallet management. Firstly, there is the production cost of conventional wooden pallets which each utilise a large number of wooded elements which are joined together to form the pallet, usually using steel nails. There is a significant cost in the transport of the empty pallets; firstly they have to be shipped to the supplier, who uses the pallets for the transport of goods to a customer. In many cases, after use they have to be shipped back to the supplier as a return. It has been found that in the case of hired pallets, for example, they spend more time being trans-shipped than actually in use.

Conventional pallets utilise a lot of storage space at each destination, and in the event of the pallets being used for perishable goods, they must be stored under p cover. It has been found that in many cases, the cost associated with the use of conventional pallets represents up to 50% of total packaging costs. Also, conventional pallets usually have wrapping material applied in one plane only, which can easily rupture.

The constant shipment of empty pallets results in a high level of pallet fatigue, resulting in damage to loads, and a high risk of injury to users due to hazardous pallet loads. The use of steel nails in the manufacture of conventional pallets is also a problem. There are significant breakages of pallets through handling causing the nails to protrude from the pallets. These frequently are a cause of motor vehicle tyre punctures and of injury to workers.

WO 99/04613 of the same applicant discloses a wrapping machine for wrapping materials, with a strip of wrapping material comprising a fist wrapping station having wrapping means for applying a strip of wrapping around the bale to partially wrap the bale in wrapping material, a second wrapping station having wrapping means for applying a strip of wrapping material around the bale to completely wrap the bale in wrapping material, and transfer means for transferring the partially wrapped bate from the first wrapping station to the second wrapping station. This machine is particularly suitable for compacting and wrapping bales of fodder and the like, but also discloses a wrapping machine for wrapping loose material, such as bricks, in a wrapping material. However, it does not disclose means for forming and wrapping a load with integral battens.

OBJECT OF THE INVENTION

It is an object of the invention to provide a method which will eliminate the conventional pallet as the main package handling system and the inefficiencies associated with conventional pallets while continuing to provide the conventional pallet's abilities as far as support and ease of transport is concerned. It is also the purpose of the invention to provide an apparatus that will fully automate a process of providing a method of forming palletized loads/stacks without the use of conventional pallets.

SUMMARY OF THE INVENTION

The invention provides a method for wrapping loads in a wrapping material comprising the steps of:

(a) placing at least two battens in a spaced, substantially parallel orientation on one surface of the load; and (b) at least partially wrapping the load in a wrapping material such that the battens are at least partially enveloped in the wrapping material and held in place on the surface of the load.

Preferably, the load is partially wrapped by establishing relative rotational motion between the load and dispensing means for the wrapping material.

In accordance with another aspect the invention provides a method for wrapping loads of goods and materials in a wrapping material, such as a plastics film, which comprises placing at least two battens in a spaced substantially parallel orientation on one surface of the load, at least partially wrapping the load in a wrapping material by rotating the load relative to dispensing means for the wrapping material, and/or rotating the dispensing means around the load, to envelop the battens in the wrapping material and to hold the battens in place on the surface of the load, the battens being placed apart to support the load and being adapted to receive therebetween the forks of a fork-lift truck for transporting the load.

In a preferred embodiment the method comprises placing the batten on a top surface of the load, partially wrapping the load at a first wrapping station with a wrapping material including overlapping at least parts of the battens with the wrapping material to hold the battens in position, turning the load through about 90° from the first wrapping station to a second wrapping station, and completing the wrapping of the load at the second wrapping station, including enveloping the battens in the wrapping material. Subsequently, the load is tipped from the second wrapping station onto the side containing the battens, which then act as a pallet to elevate and support the load for transport. That is, the battens provide the same function as a pallet in elevating the base of the wrapped load or stack off the ground to allow the forks of a fork lift truck to enter under the load.

The invention also includes apparatus for carrying out the method comprising a first wrapping station including a wrapping platform to receive the load to be wrapped, batten placing means for placing battens on a surface of the load, wrapping material dispensing means at the first wrapping station, means for rotating the platform relative to dispensing means, and/or means for rotating the dispenser relative to the platform, to partially wrap the load, including at least part of the battens, with the wrapping material, means for transferring the load, through about 90° to a second wrapping station, and means at the second wrapping station for completing the wrapping of the load.

Preferably, the wrapping means at the first wrapping station includes means for rotating the load about a vertical axis, and the wrapping means at the second wrapping station includes a belt table for rotating the load about a substantially horizontal axis and film dispensing means for rotation about a substantially vertical axis to apply film to the load as it is rotated about a horizontal axis.

Alternatively, the belt table is additionally rotated about a vertical axis relative to the film dispensing means.

Preferably, the belt table at the second wrapping station is pivotable from a normally horizontal position, through approximately 90°, to a position in which engagement means on the belt table engage with means on the wrapping platform, and the wrapping platform is pivotally mounted, such that when the belt table is returned to its original horizontal position it causes the wrapping platform to swing from a normally horizontal position, through approximately 90°, to deposit the partially wrapped load onto the belt table at the second wrapping station.

The engagement means may include tie-rams.

The apparatus may include a tipping device positioned forwardly of the belt table by means of which the load may be tipped from the apparatus. Suitably, the belt table is pivotable about a substantially horizontal axis to transfer the wrapped load onto the tipping device. Thus, the belt table is pivotable from either end, such that it can be tipped forwardly, through 90°, to receive the load from the first wrapping station, and can be tipped rearwardly to off-load the load.

To achieve transfer of a load from the wrapping platform at the first wrapping station to the second wrapping station, the belt table at the second wrapping station is tipped forwardly, through 90°, by means of a hydraulic ram which is pivotably connected to the wrapping platform assembly at the first wrapping station such that when the wrapping platform is pivoted through 90°, by a second hydraulic ram, the belt table is caused to pivot back, through 90°, to its original horizontal position to receive the partially wrapped load.

The invention also relates to a wrapped load/stack including at least two substantially parallel battens located on at least one side surface of the load and held in position by the wrapping material.

The method and apparatus of the invention provides for wrapped loads/stacks with integral supports thus eliminating many of the inefficiencies and costs associated with the use of conventional pallets. The apparatus of the invention replaces the conventional pallet with two or three battens held in place by the wrapping. The wrapping is applied in two planes substantially at right angles to each other, thus giving high levels of strength and providing a very secure package. Also, depending upon the amount of wrapping material applied, the wrapped load may be rendered water tight and air tight.

It is estimated that utilising the method and apparatus of the invention there is a saving in the volume of timber of about 74.45 (neglecting saw losses which are higher with pallets) compared to the volume of timber needed to manufacture conventional pallets. This means that for every load on a pallet, four separate loads could be produced on battens using the same amount of timber. However, in terms of pallet return transport costs there is an even more dramatic saving. It is estimated that there is a reduction of about 93% in the transportation volumes using the battens of the invention in place of conventional pallets. This makes a very positive contribution in reducing environmental pollution both in terms of vehicle emission and wood/nail waste with the inherent cost savings on pallet storage, space/stocking logistics, transport and recovery cost and management time. Furthermore, the battens are likely to have a far longer lifespan than pallets because they are less susceptible to change.

Further benefits are the provision of a robust packing method which results in a strong, airtight (important where oxidation, fermentation and moisture loss are concerned), waterproof and easily handled package.

BRIEF DESCRIPTION OF THE DRAWINGS

An embodiment of the invention is hereinafter described with reference to the accompanying drawings, wherein.

DETAILED DESCRIPTION

Figure 1:
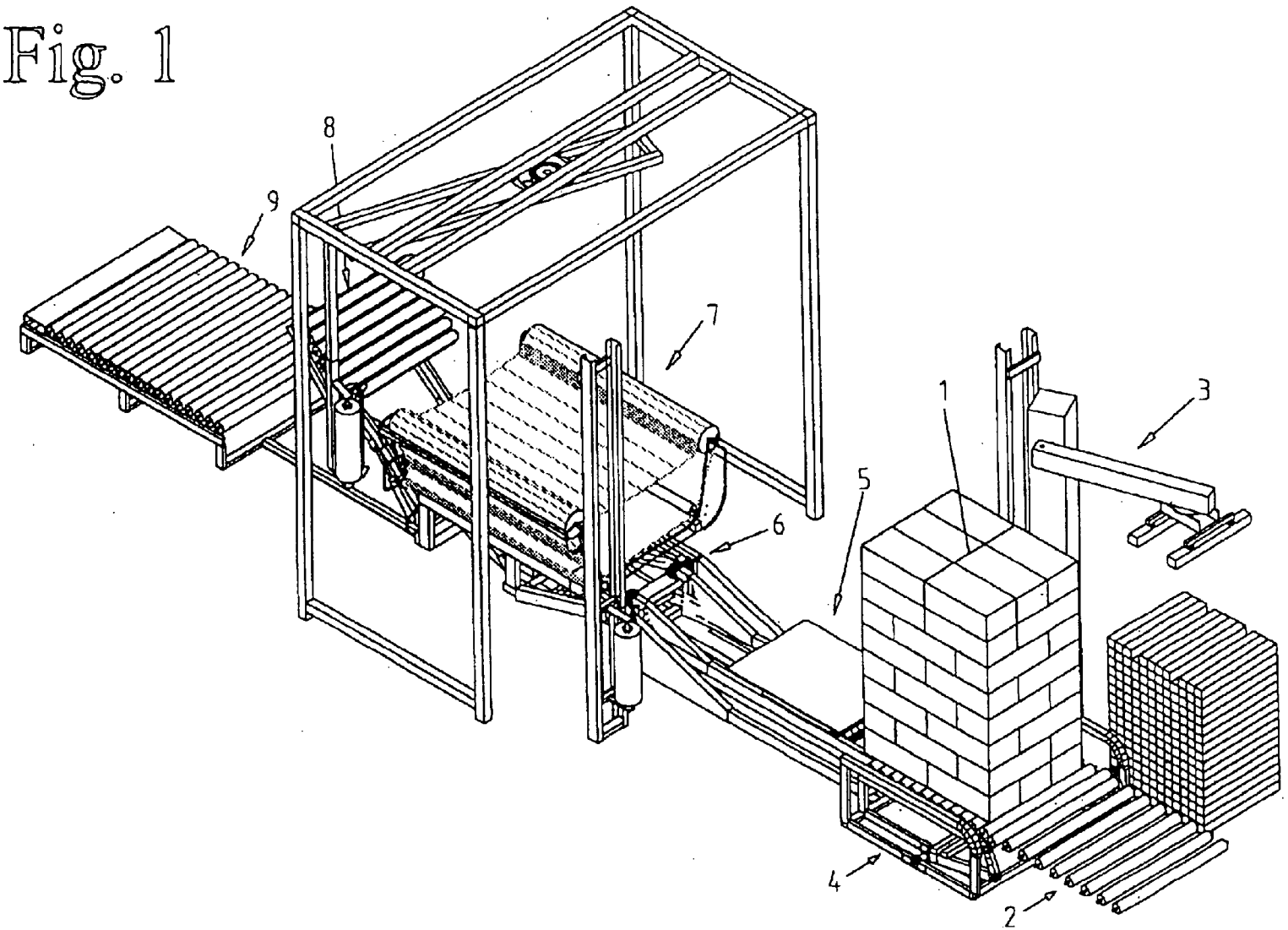
FIG. 1 is an overall isometric view of the apparatus of the invention.

Referring to FIG. 1 of the drawings, an embodiment of the wrapping and pelletizing machine of the invention is shown in isometric view. A load or stack (1) to be wrapped and pelletized may comprise any goods, materials, cartons, boxes and the like, which are typically transported by means of pallets. Suitably, the maximum dimensions of the load (1) are from about 500–1600 mm in width and from about 1000–2200 mm in height.

The embodiment of the machine shown in FIG. 1, looking at it from right to left, comprises of:

An input conveyor (2)

A batten pick and place unit (3)

A buffer conveyor section (4)

A first wrapping station (5)

A transfer means (6)

A second wrapping station (7)

An off-loading means (8)

An output conveyor section (9)

Figure 2:
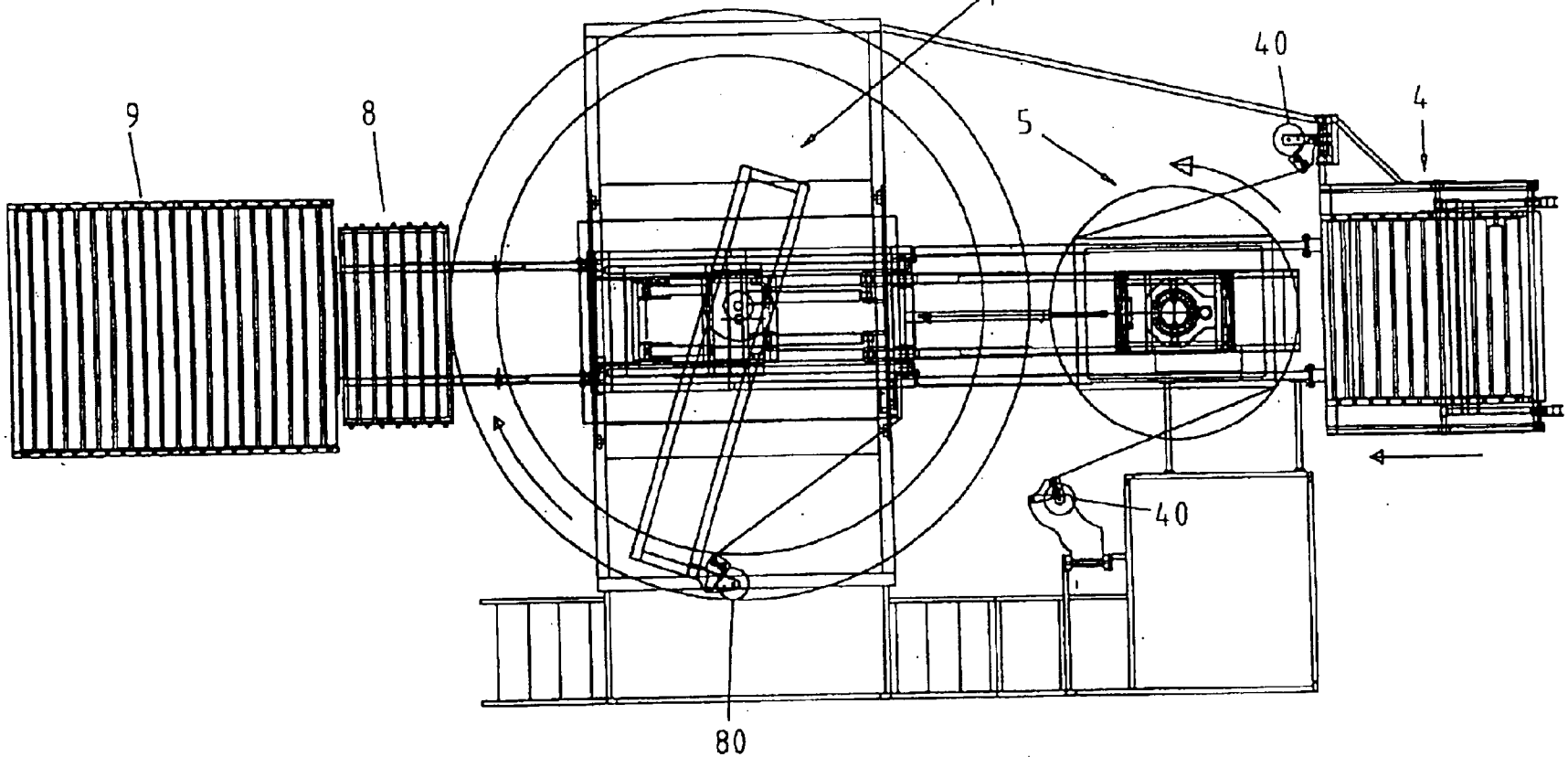
FIG. 2 is an overall plan view.

In operation of the machine the load 1, comprising a stack of material, is first driven onto the buffer conveyor 4 (see FIG. 2), from the packaging plant, using a delivery system e.g. driven conveyor rollers 2.

Batten Placing

Figure 4:
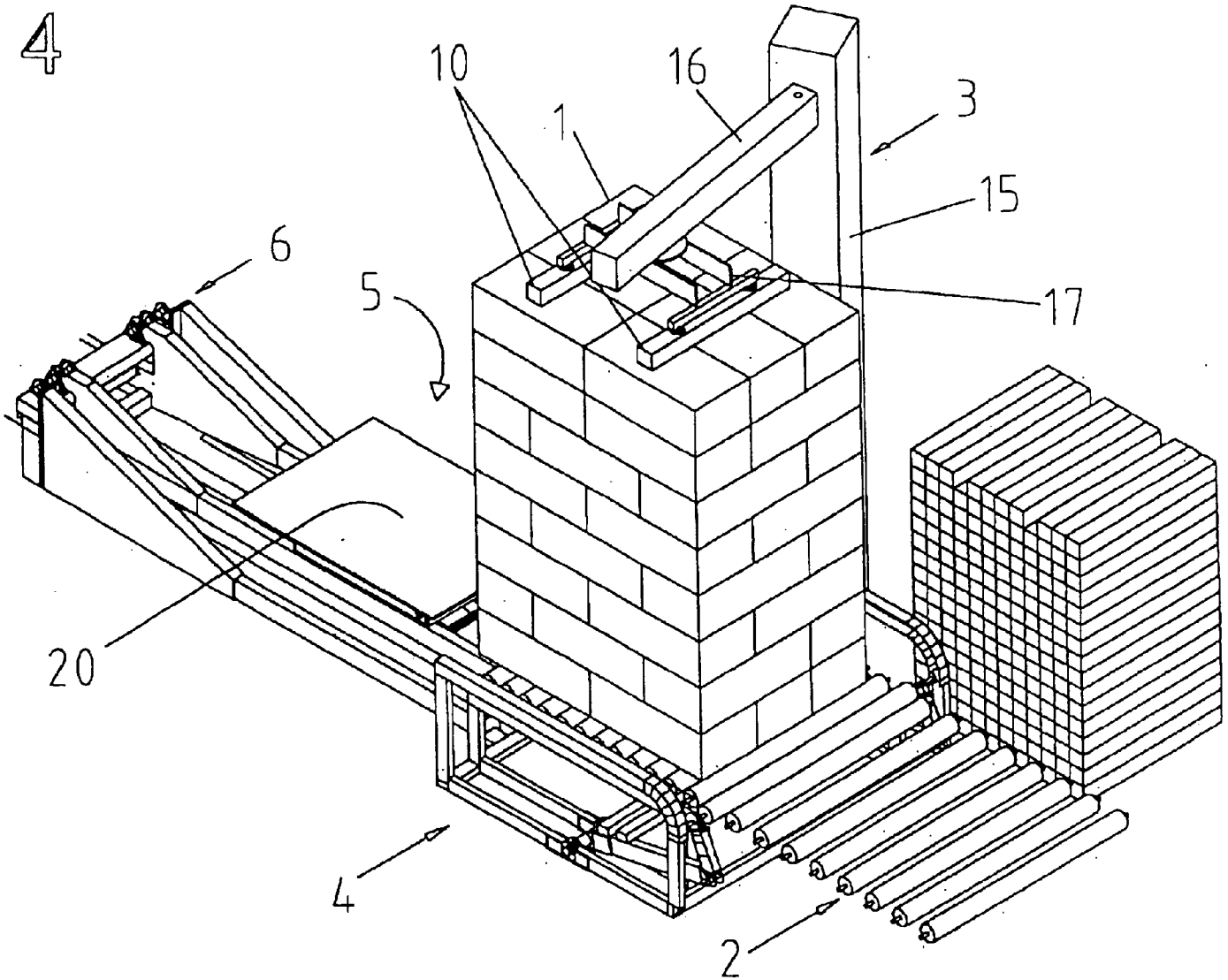
FIG. 4 is an isometric view of part of the machine at the first stage of operation.

A fully automated pick and place unit 3 then commences operation. The pick and place unit suitably comprises an upright column 15 on which is mounted a vertically slidable arm 16, which carries a pick and place mechanism 1 (see FIG. 4). The arm 16 is pivotally connected at one end to the column 15 and at its other end to the pick and place mechanism 17. The pick and place mechanism picks up a pair of battens (10) from a stack or dispenser unit and places them in a parallel orientation, spaced substantially apart, on the top surface of the load 1. The pick and place mechanism may optionally include vacuum cups or mechanical grabs to grip the battens.

Figure 3:
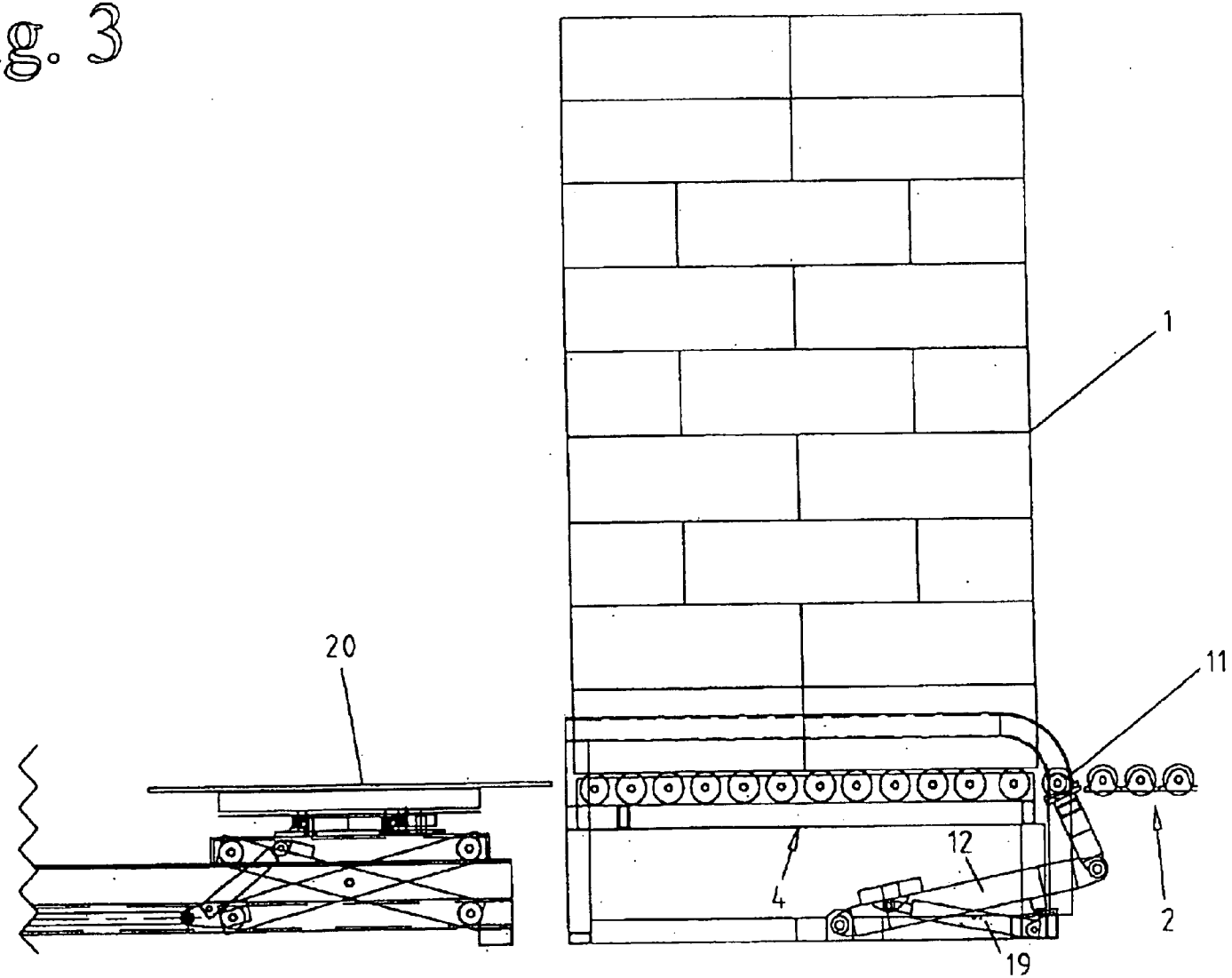
FIG. 3 is an elevation of a part of the apparatus at the first stage of operation.

Referring to FIG. 3, the load 1 is moved from the buffer conveyor section 4 onto a turntable 20 of the first wrapping station 5. This is achieved by means of a push-roller 11 mounted transversely on arms 12. The push-roller arms 12 arc rotated by a hydraulic ram 19, about a pivot point, at the lower ends of the arms, causing the push-roller 11 to travel up vertically, above the level of the conveyor rollers comprising the buffer conveyor 4, and then horizontally along guide rails 13, disposed to each side of the buffer conveyor 4. When the load 1 is in the correct position on the turntable, the push-roller 11 is retracted into a stand-by position, so that the next load 1 can travel over it onto the buffer conveyor 4.

First Wrapping Station

Figure 8:
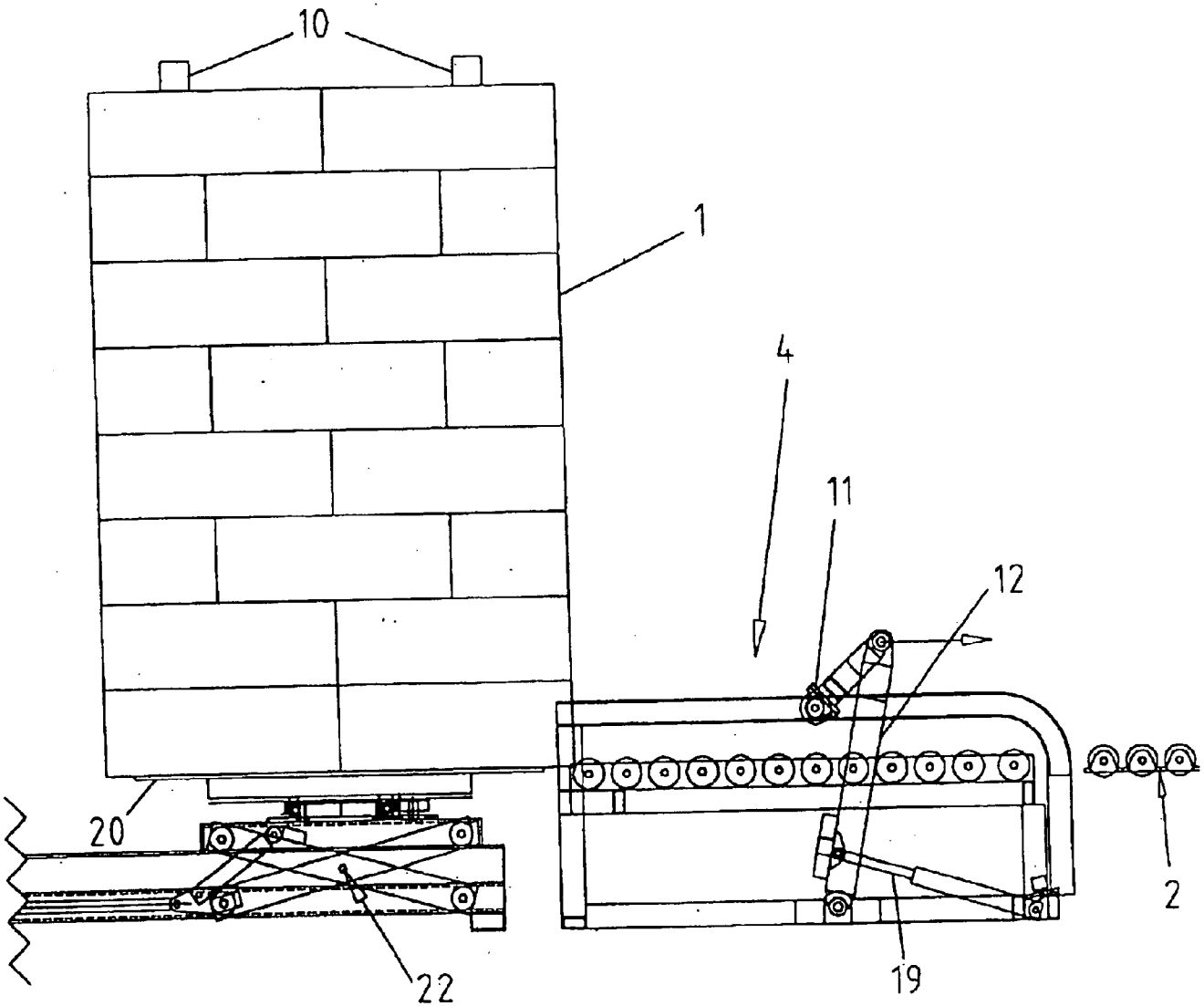
FIGS. 8 and 9 are elevation views illustrating the retraction of a push roller of the invention.
Figure 9:
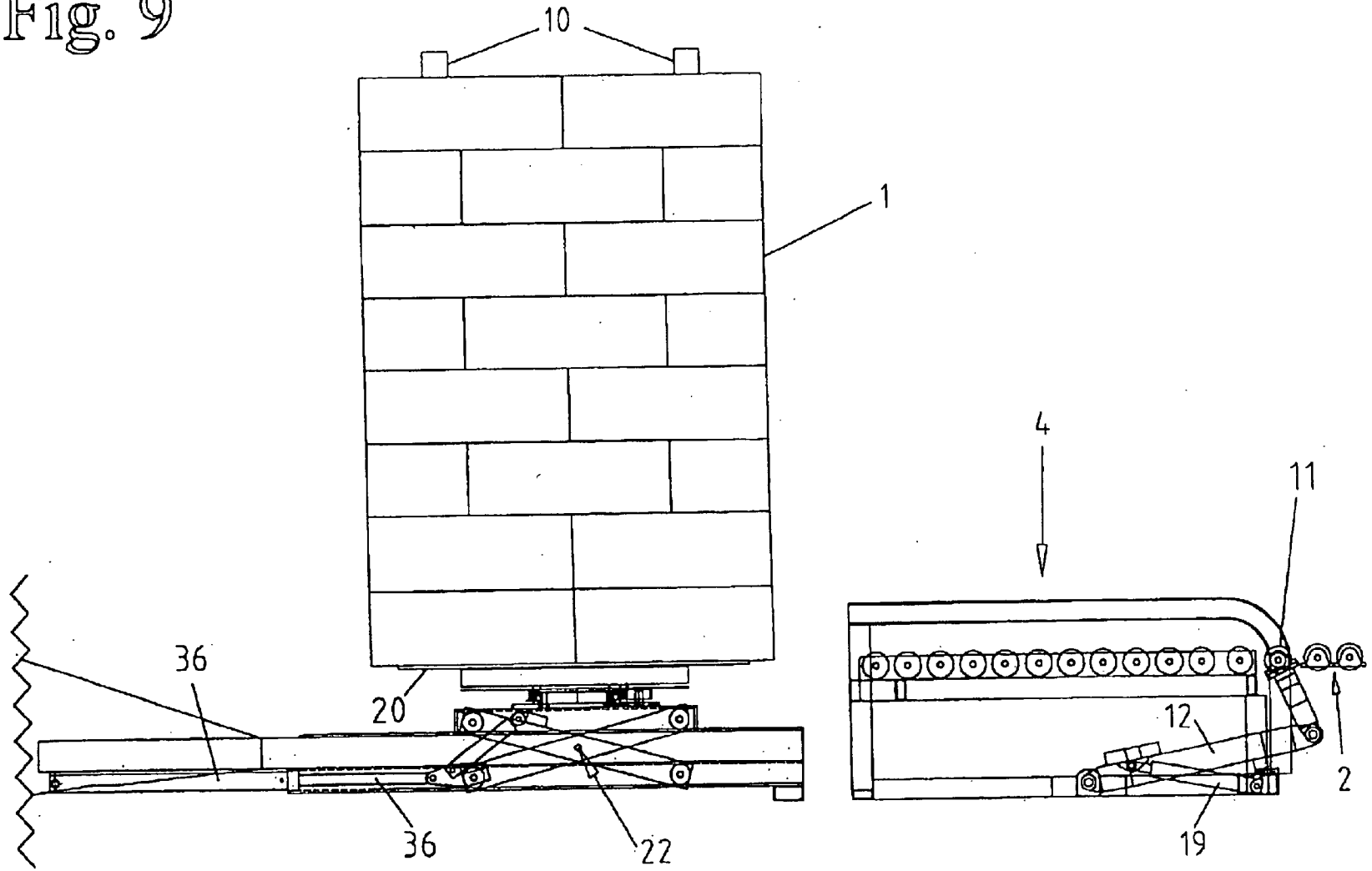

When the load 1 is located on the wrapping platform 20, (as shown in FIGS. 8 and 9), the first wrapping cycle can begin. Optionally, during the first wrapping cycle the pick and place mechanism 17 may hold the battens 10 in place on the top of the load 1, or a separate mechanism may be provided to achieve this.

In this embodiment the wrapping platform 20 is in the form of a rotary turntable, details of which are shown in FIGS. 8, 9, 14 and 16. The platform 20 is mounted on a scissors mechanism 22, which is shown in a collapsed position in FIGS. 8 and 9 such that the platform 20 is aligned with the second conveyor section 11, to receive the load from the conveyor 4.

Figure 14:
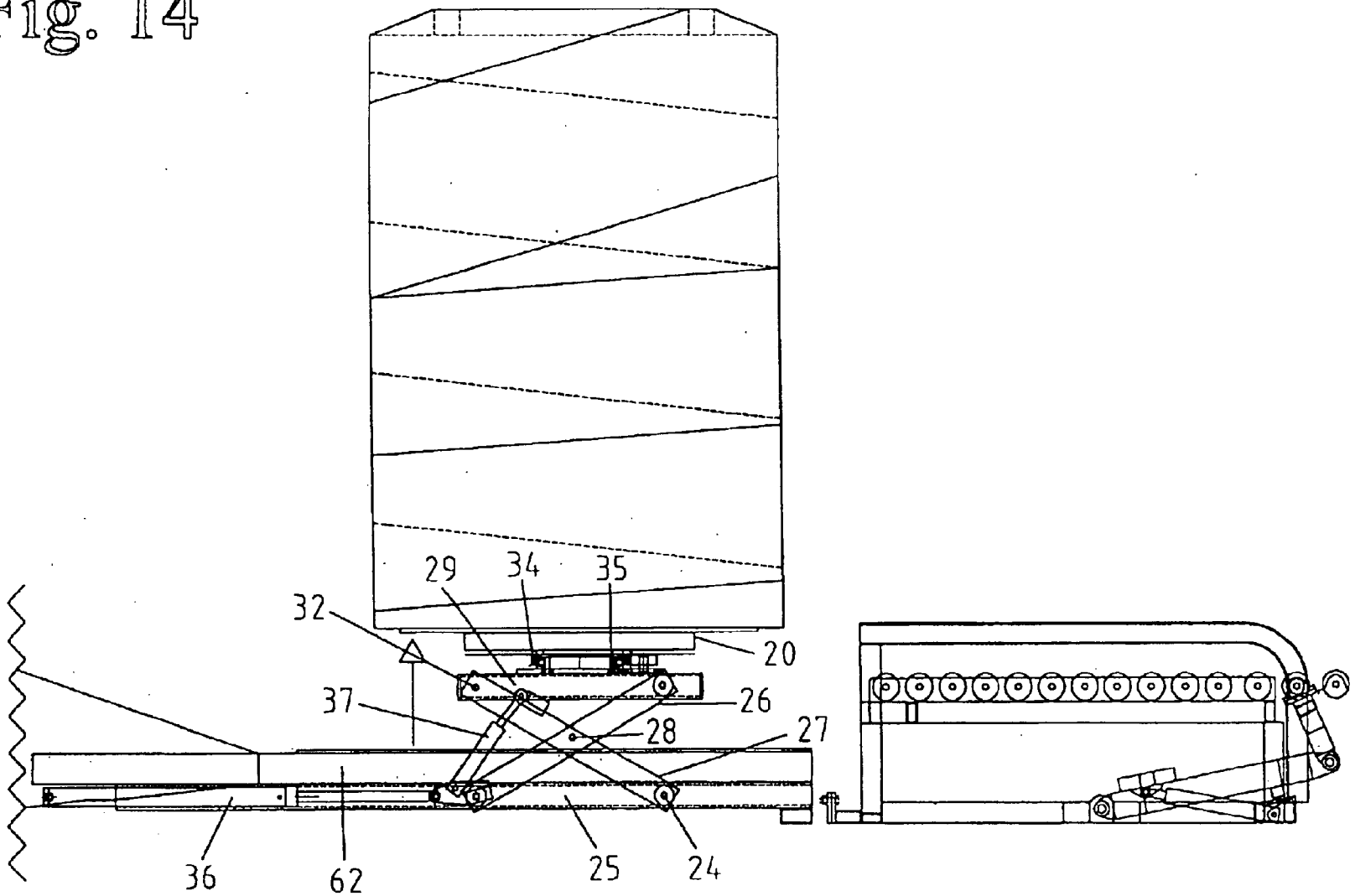
FIG. 14 is an elevation showing a first wrapping station at the end of the first wrapping cycle.
Figure 16:
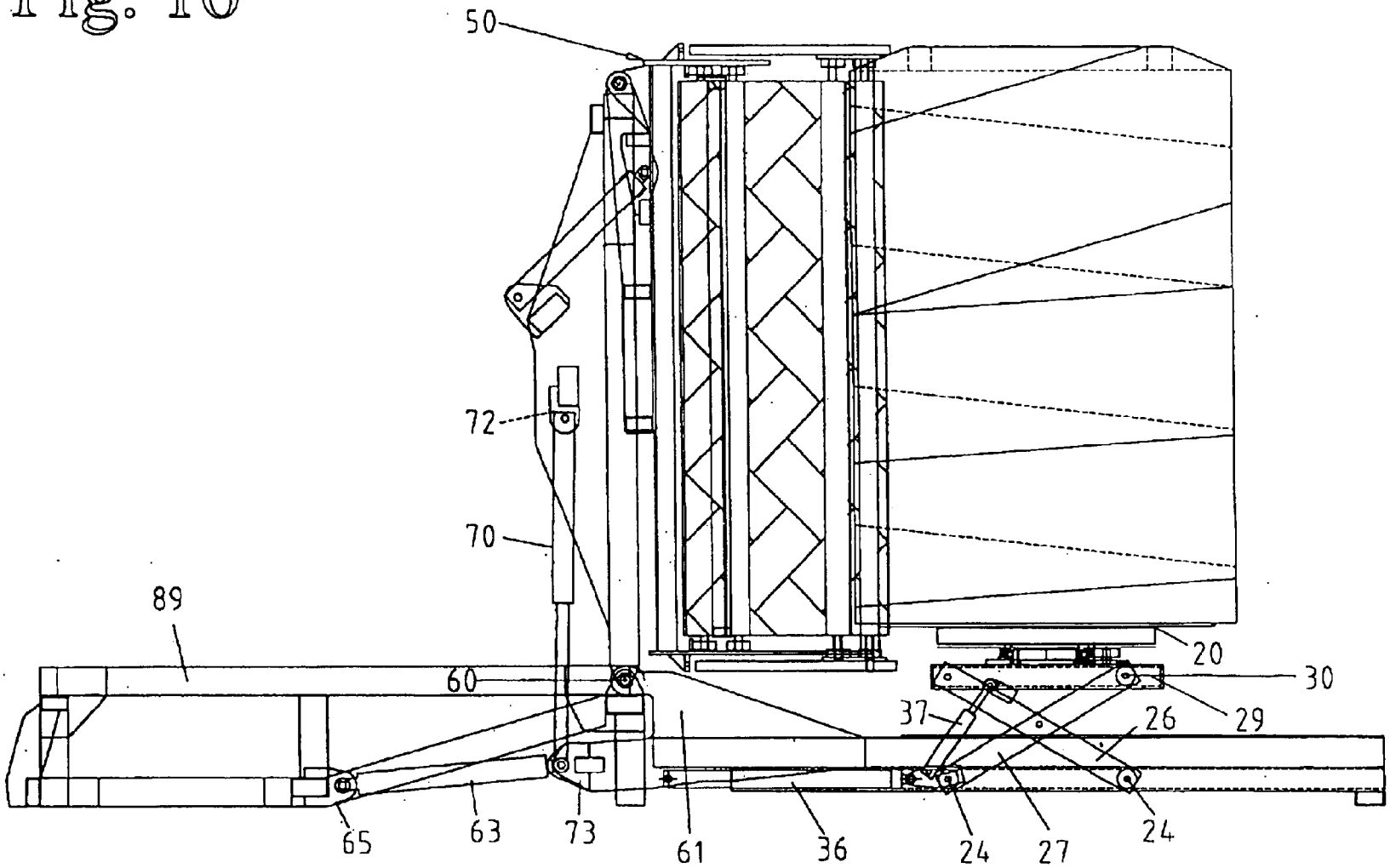

Details of the wrapping platform 20 and scissors mechanism are shown most clearly in FIGS. 14 and 16. The turntable 20 and scissors assembly are mounted on horizontally on the parallel channel rails 25, by means of a hydraulic transport ram 36, or a rack and pinion (not shown).

The scissors mechanism 22 comprises two pairs of crossed arms 26, 27, one pair being disposed to each side of the platform.20. The arms 26, 27 are pivotally connected, by a pivot 28, at their centres. The top ends of the arms 26, 27 support a horizontal frame 29 which carries the wrapping platform 20. The top left side (as shown in FIGS. 14 and 16) of the arms 26, are connected to a fixed pivot 32, whereas, the top right and the bottom ends of arms 26, 27 are connected to the wheels 24, which are free to slide horizontally in the guide channels 25. The top ends of arms 27 have wheels 30, which run in channels in the frame 29. Thus, by expanding a ran 36, which is connected to the arms 26, 27, the wheels 24 are brought closer together to cause the scissors mechanism 22 to expand to raise the frame 29 vertically upwards.

Figure 7:
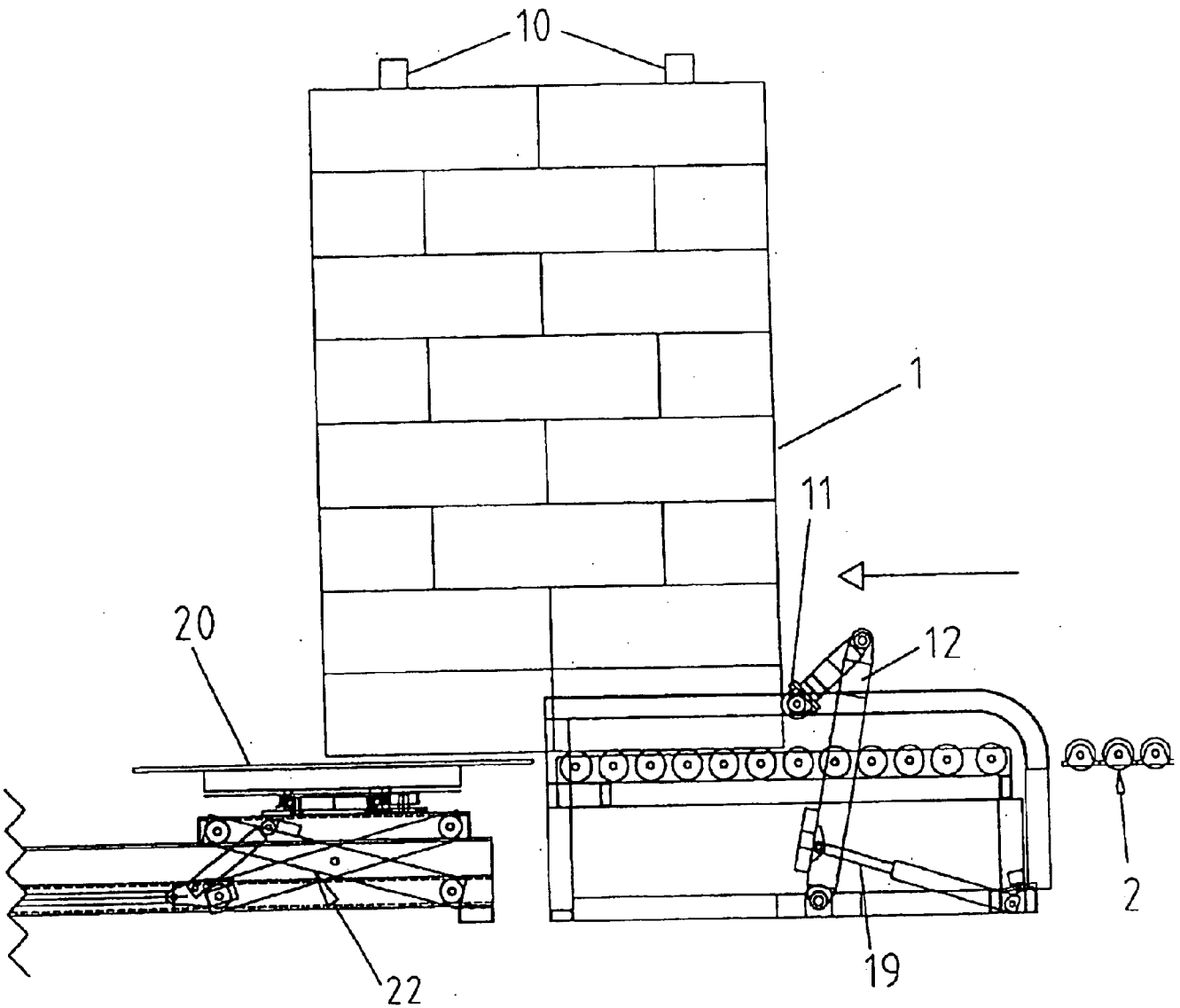
Figure 11:
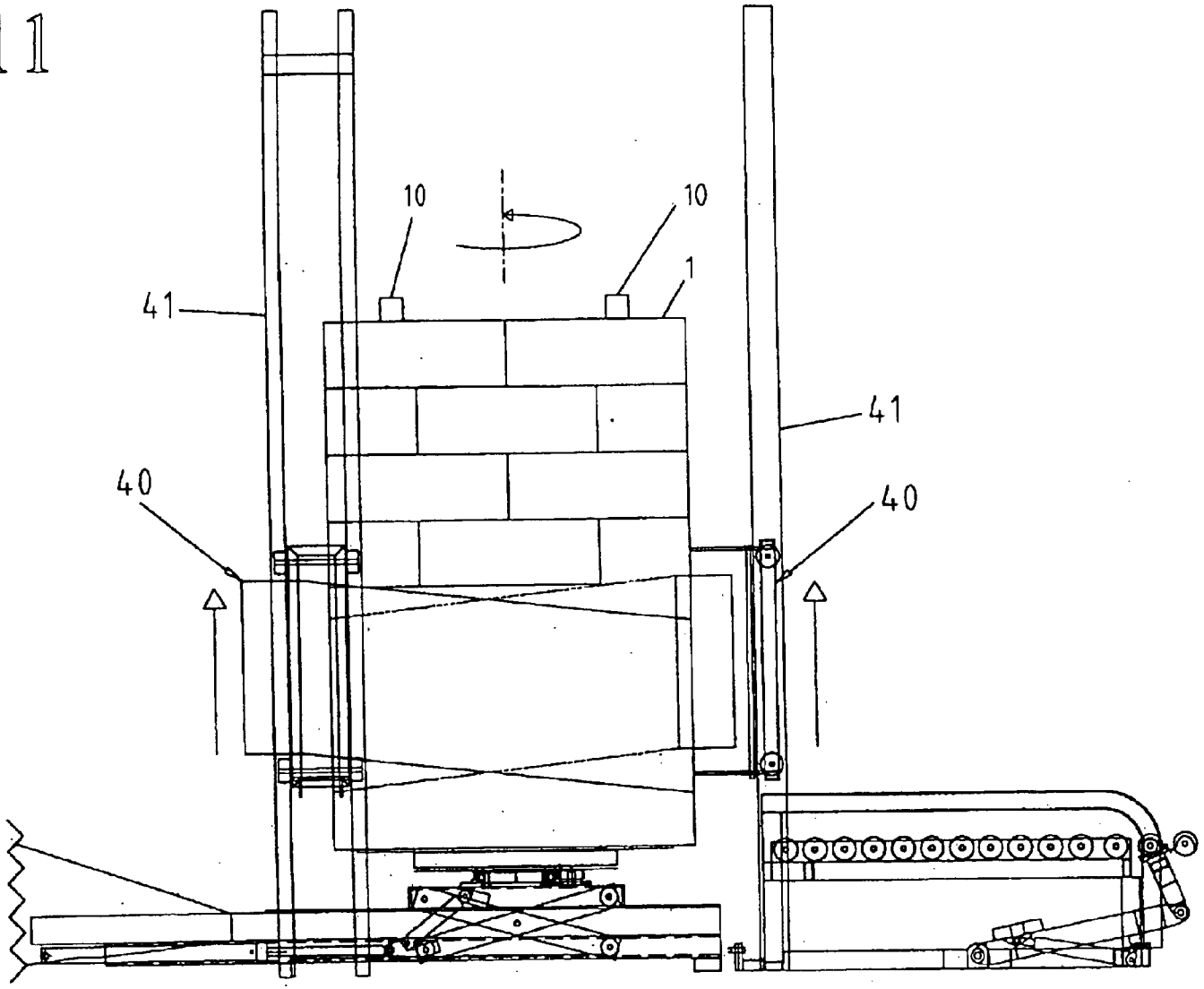
Figure 13:
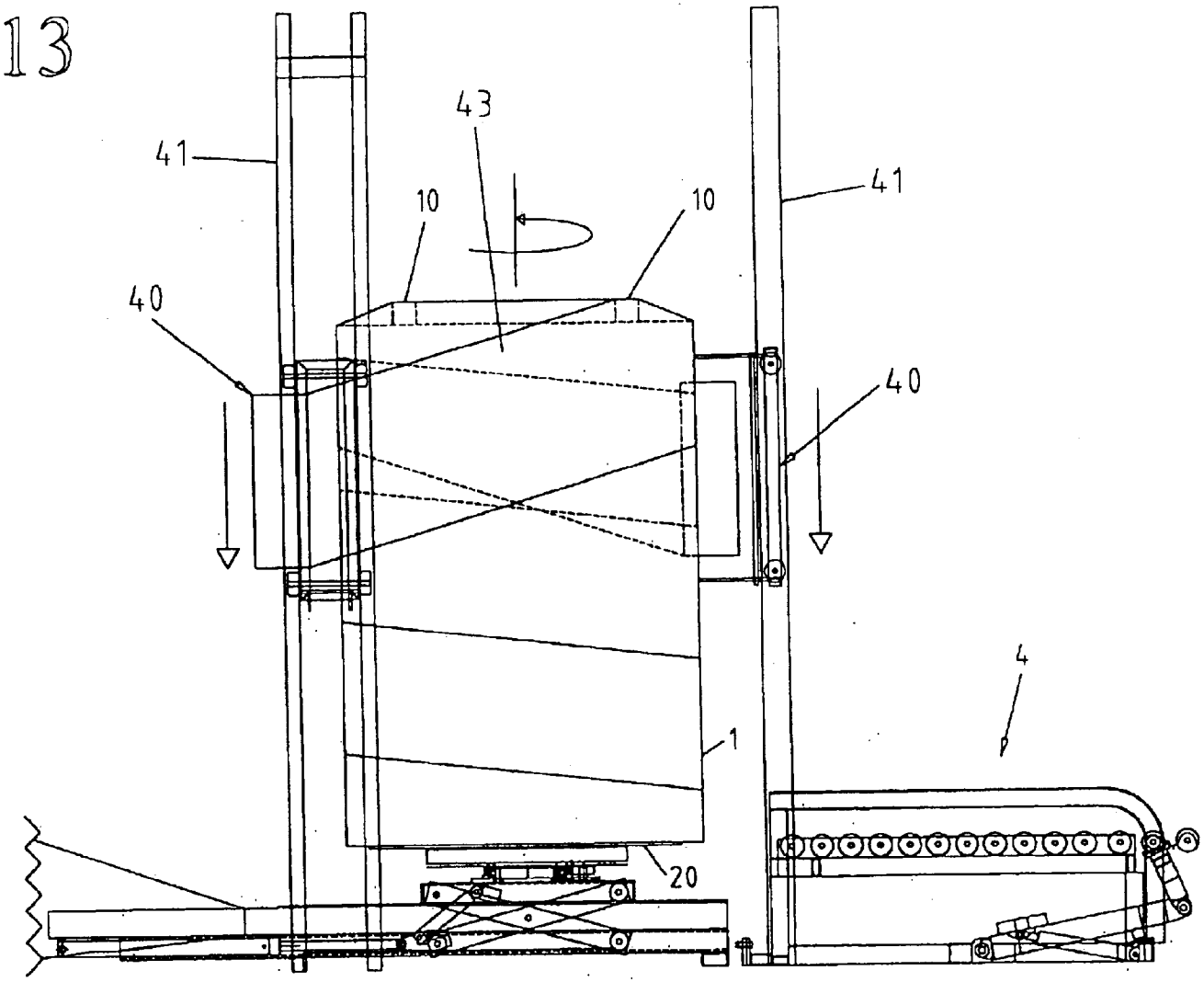

The scissors mechanism 22 is shown completely collapsed in FIGS. 7, 11 and 13, with the platform 20 coplanar with the conveyor 11. It is shown partly raised in FIGS. 14 and 15. In this embodiment the stroke of the ram is about 353 mm which can move the wrapping platform 20 vertically through a height of about 650 mm. Thus, the platform 20 can locate different height loads correctly at the centre of a belt table 50 of the second wrapping means as will be described more fully below.

Referring to FIG. 14, the wrapping platform 20 is mounted for rotation on the frame 29 by means of an externally driven slew ring 34. The slew ring 34 is fixed the underside of the platform 20, and the slew ring rotates relative to an internal ring 35 fixed to the frame 29. The diameter of the slew ring 34 is typically about 400 mm. The slew ring 34 is driven by an electric or hydraulic motor (not shown), mounted on the frame 29 which engages with teeth on the external periphery of the slew ring. The speed of the motor is ramped up, and ramped down, for safe starting and stopping of the rotation of the wrapping platform 20.

Before wrapping is commenced at the fist wrapping station 5, the rotary wrapping platform 20 is retracted, from the position shown in FIG. 8, where it abuts the rollers of the buffer conveyor 4, to a wrapping position as shown in FIG. 9, where the platform 20 is spaced from the rollers 4. The movement of the wrapping platform 20 is achieved by the hydraulic ram 36, which pulls the scissors mechanism 22 along the channel rails 25.

First Wrapping Step

Figure 10:
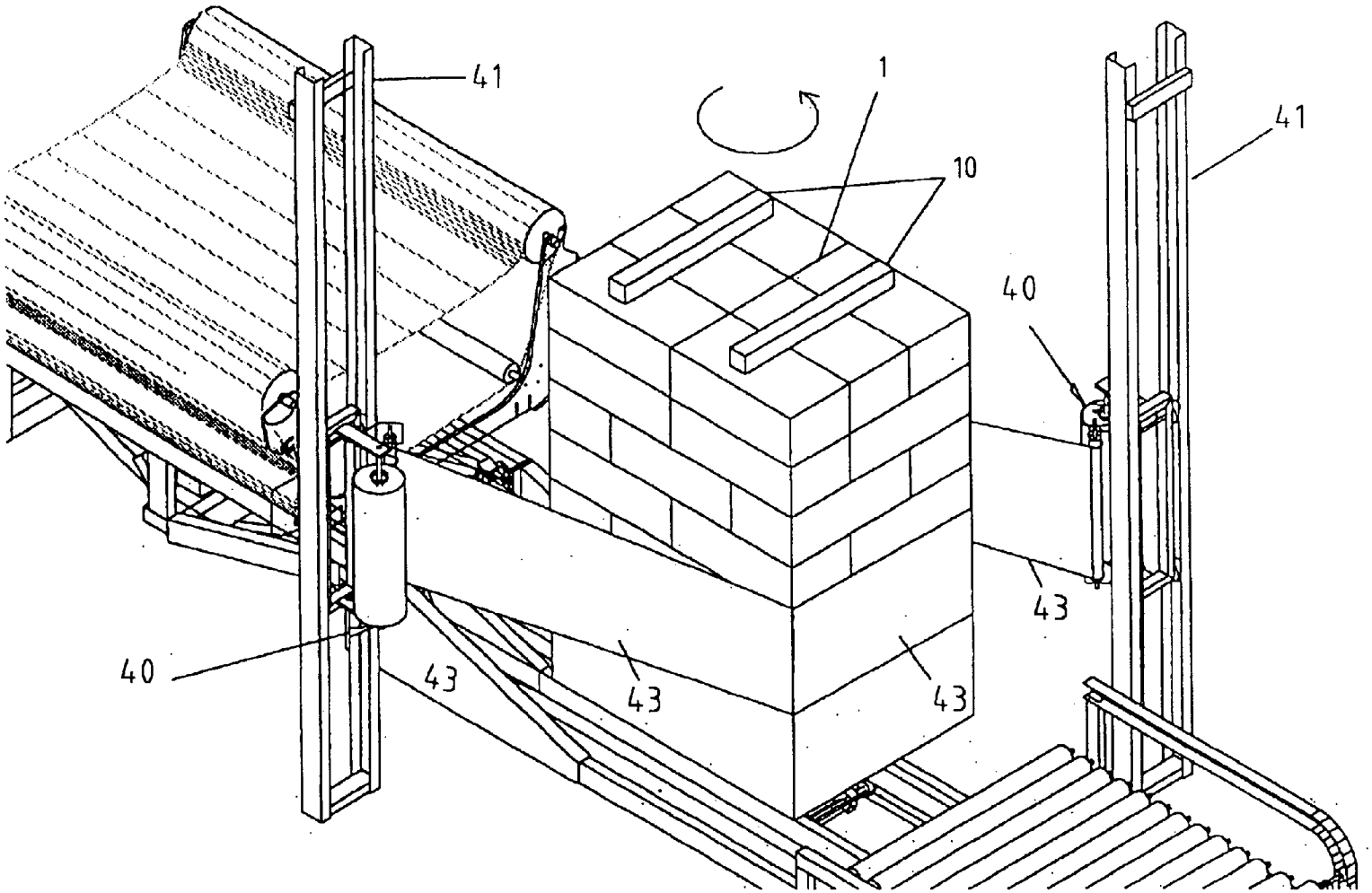
FIGS. 10 and 11 arc isometric and elevational views of the part of the apparatus at the commencement of wrapping at a first wrapping station.

The first wrapping step is illustrated in FIGS. 10 and 11. The wrapping platform 20 is rotated, which in turn causes the load 1 (with battens 10 on top) to rotate about a vertical axis; in the direction of the arrows shown in FIGS. 10 and 11. Two film dispensers 40 are mounted on uprights 41, located to each side of the first wrapping station. The film dispensers 4 are of well known constructions and each may include a pretensioning unit through which plastics wrapping film 43 is fed and stretched. Two cut and start devices (not shown) for severing the film at the end of wrapping, e.g. of the kind shown in IE S80403, are mounted on the rotary wrapping platform 20.

At the start of the wrapping cycle, the free ends of the film 43 are attached to the cut and start devices on the wrapping platform 20, and the platform 20 is caused to rotate by the motor 37. This in turn unwinds the film 43 from the two dispensers 40, and causes the film to wrap around the load 1 (see FIG. 10).

Optionally, as mentioned above, as the load 1 is rotated by the turntable 20, the arm 16, carrying the battens 18, may press down on the top of the load 1 to hold the battens 18 in position. This is possible because of a pivot between the arm 16 and the pick and place mechanism 17.

Figure 12:
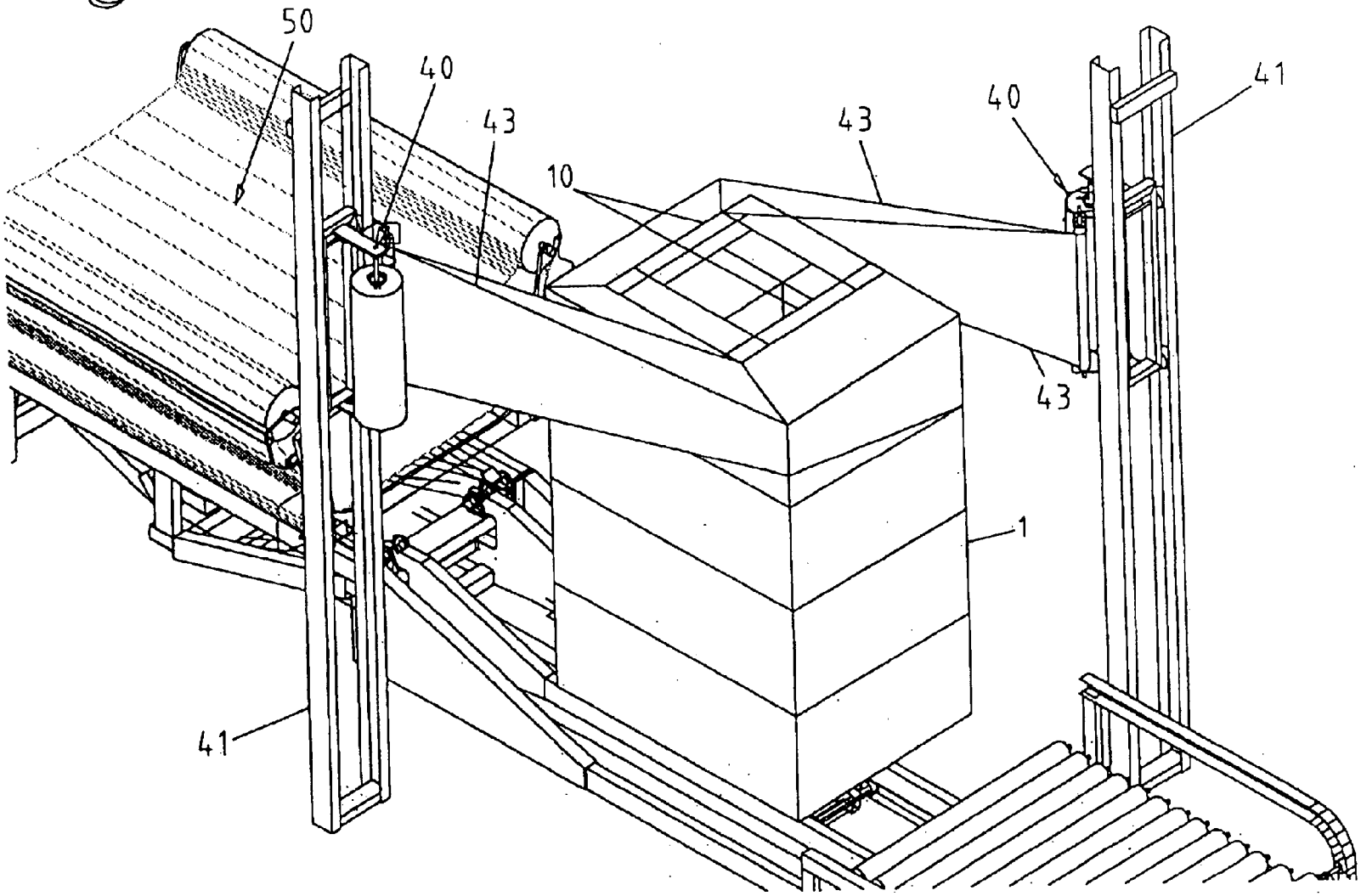
FIGS. 12 and 13 are views similar to FIGS. 10 and 11, respectively, at a further stage of the wrapping process.

During the wrapping process, the wrapping film overlaps the bottom comers of the load 1. Wrapping continues at this location until all of the exposed side walls of the load 1 are wrapped in the wrapping film 43. The film dispensers 40 arc moved vertically upwards along the guide columns 41 to effect a complete wrapping, the individual strands being applied in a spiral configuration, with one strand overlapping the other (see FIG. 11). At the top of the load 1, the wrapping material overlaps the top corners and also the ends of the battens 18 to secure the battens in position on top of the load 1. When the dispensers 40 reach the top of the load 1 (set FIG. 12), an adjustable position sensor stops the upwards travel of the dispensers.

Figure 5:
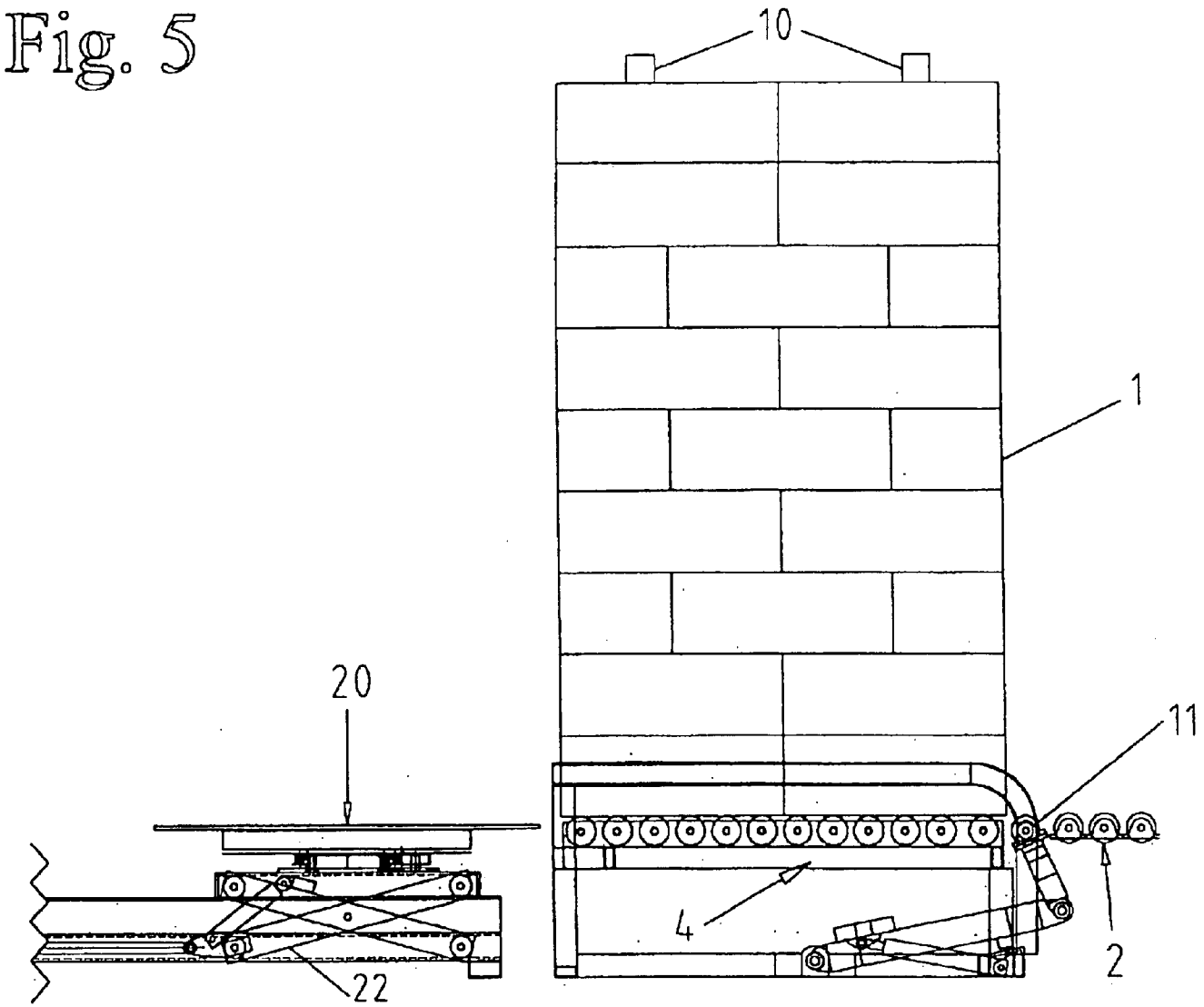
FIG. 5 is an elevation corresponding to FIG. 4.
Figure 6:
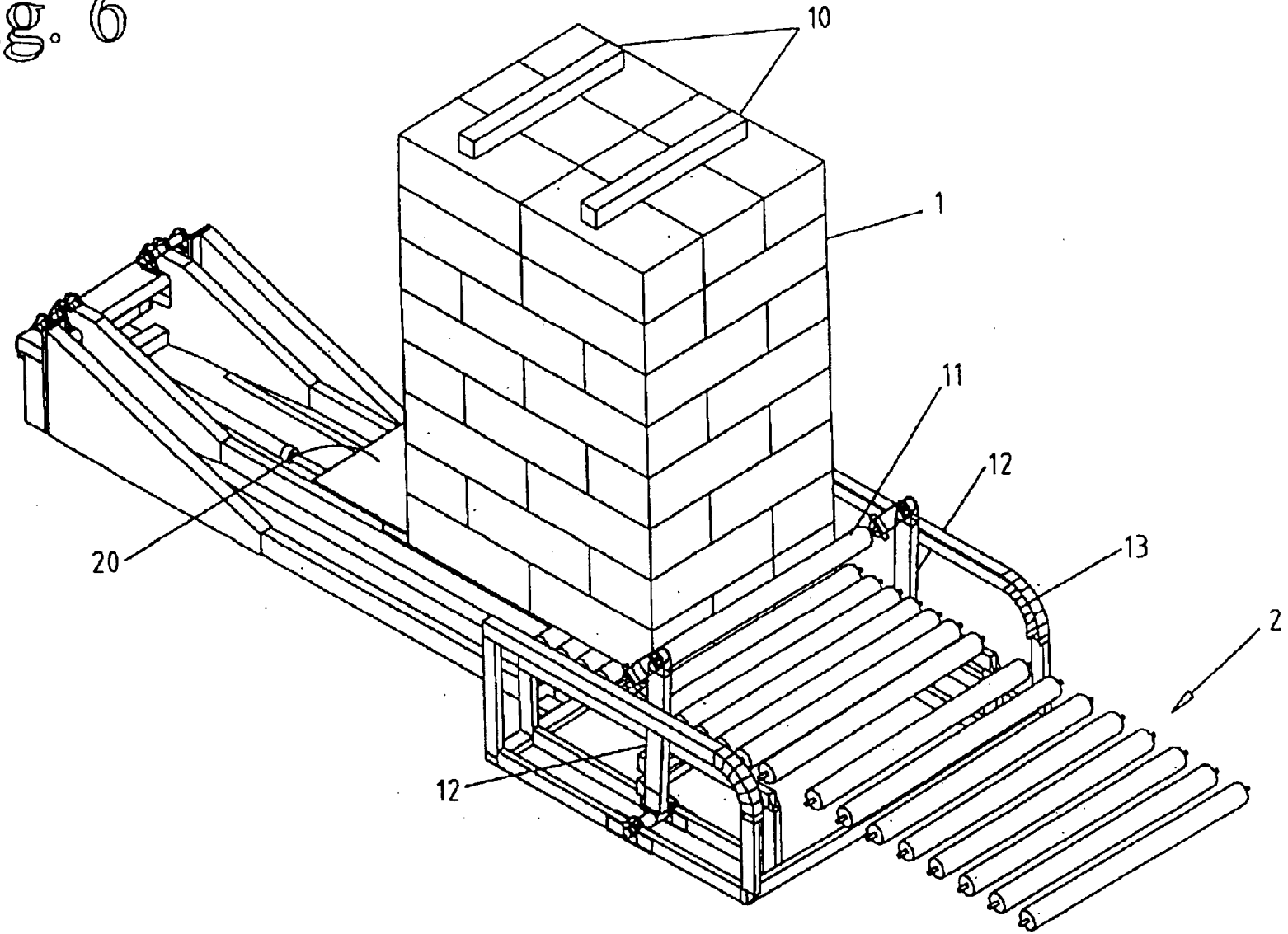
FIGS. 6 and 7 are isometric and elevational views, respectively, of part of the apparatus at the next stage of operation.

When adequate film 43 has been applied to the top of the load 1 the dispensers 40 travel back down to the bottom while continuing to wrap the load 1. When they reach the bottom, the cut and start mechanisms catch the films 43, cut the ends attached to the load 1, while holding the ends attached to the dispensers. At this stage, first station wrapping is complete and the load 1 has been fully wrapped around a vertical axis. At the bottom of the load the wrapping material overlaps the edge portions of the platform 20. In an optional arrangement, the arm 16 is then raised to release the pick and place mechanism 17. Simultaneously, a new load 1 is advanced towards the pick and place unit 3, as shown in FIG. 5.

At the end of the first wrapping process, the rotary platform 20 orients the load so that it is at the correct orientation for transfer to the second wrapping station. Although not shown in the drawings, another optional feature is that the rotary platform 20 may be reduced in size to facilitate its disengagement from the load 1, in particular from overlapping portions of the wrapping material. This may be achieved by having the wrapping platform in two separate parts, which normally are spaced apart a short distance during wrapping, but which are brought together, e.g. by a hydraulic ram to reduce the overall size of the platform.

As shown in FIG. 14, after first wrapping is completed, the scissors frame 29 is raised by ram 37, to ensure that the partially-wrapped load 1 is positioned centrally on a belt table 50 of the second wrapping station 7, to which it is transferred as described below.

Figure 15:
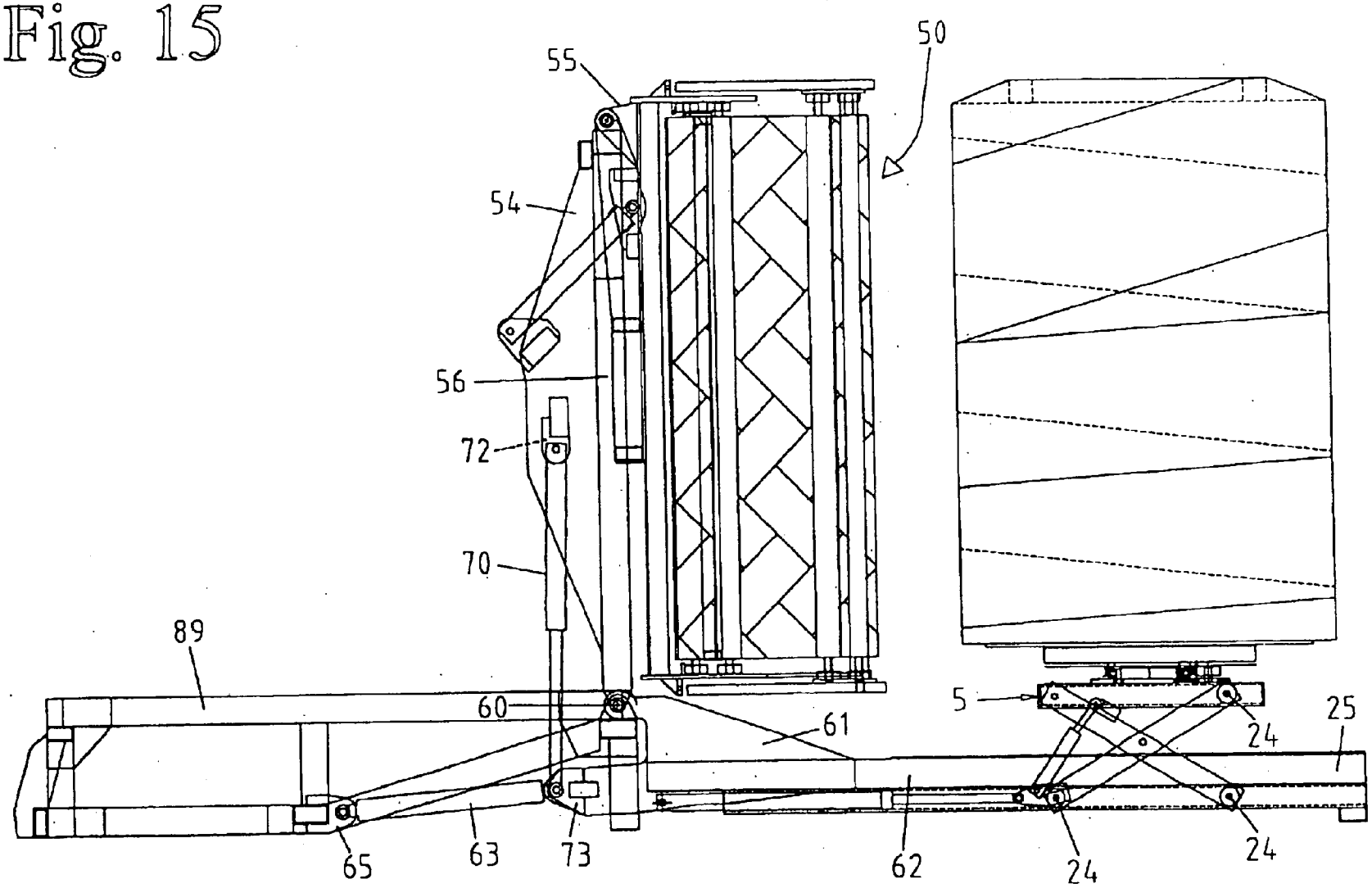
FIGS. 15 and 16 are elevational views showing the first/second stage in the transfer of a partially-wrapping load to a second wrapping station.
Figure 20:
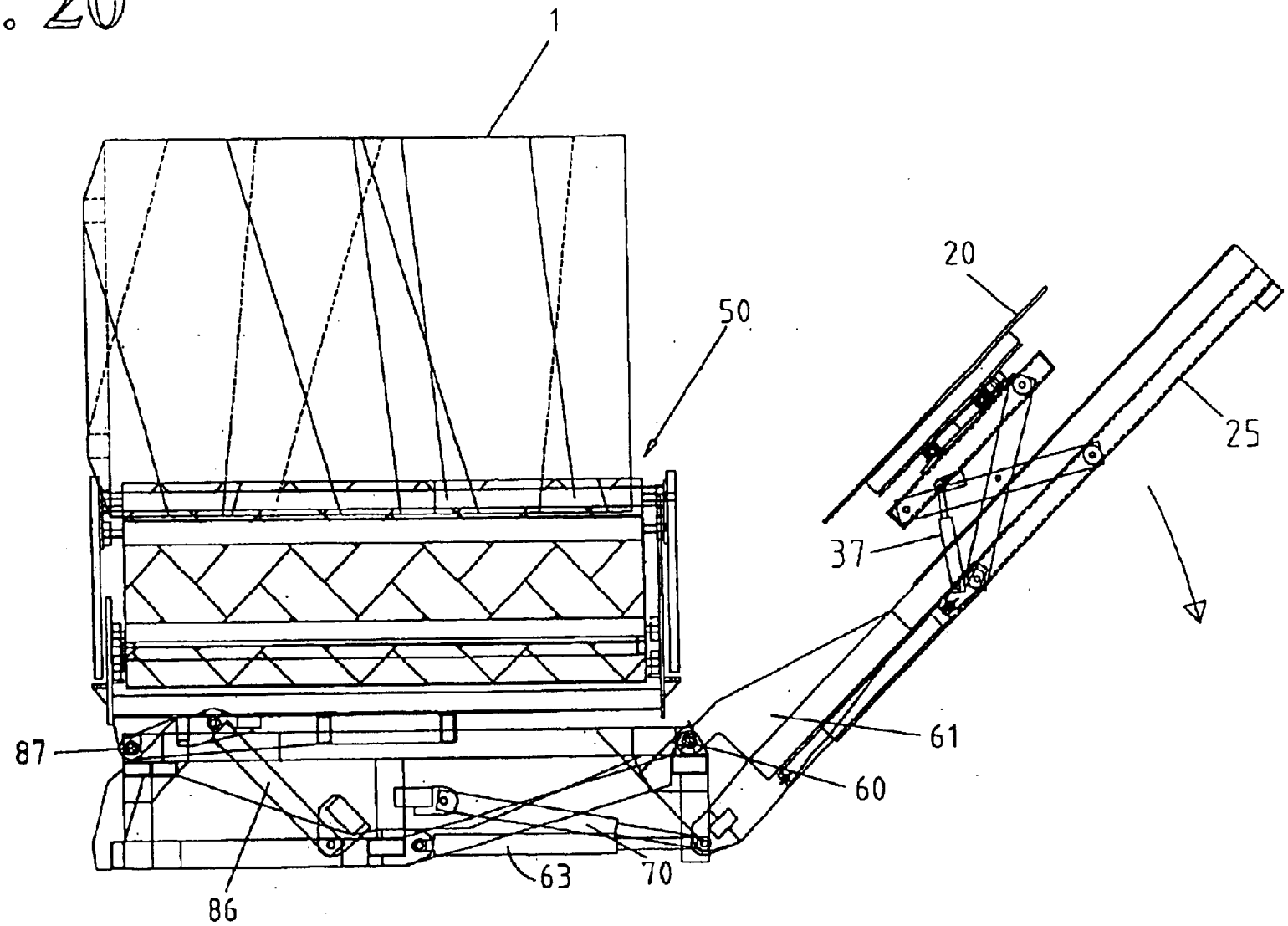

The transfer means 6 operates to transfer the partly wrapped bale, by turning it through about 90°, from the first wrapping station 5 to the second wrapping station 7, as shown in FIGS. 15 and 20.

Figure 21:
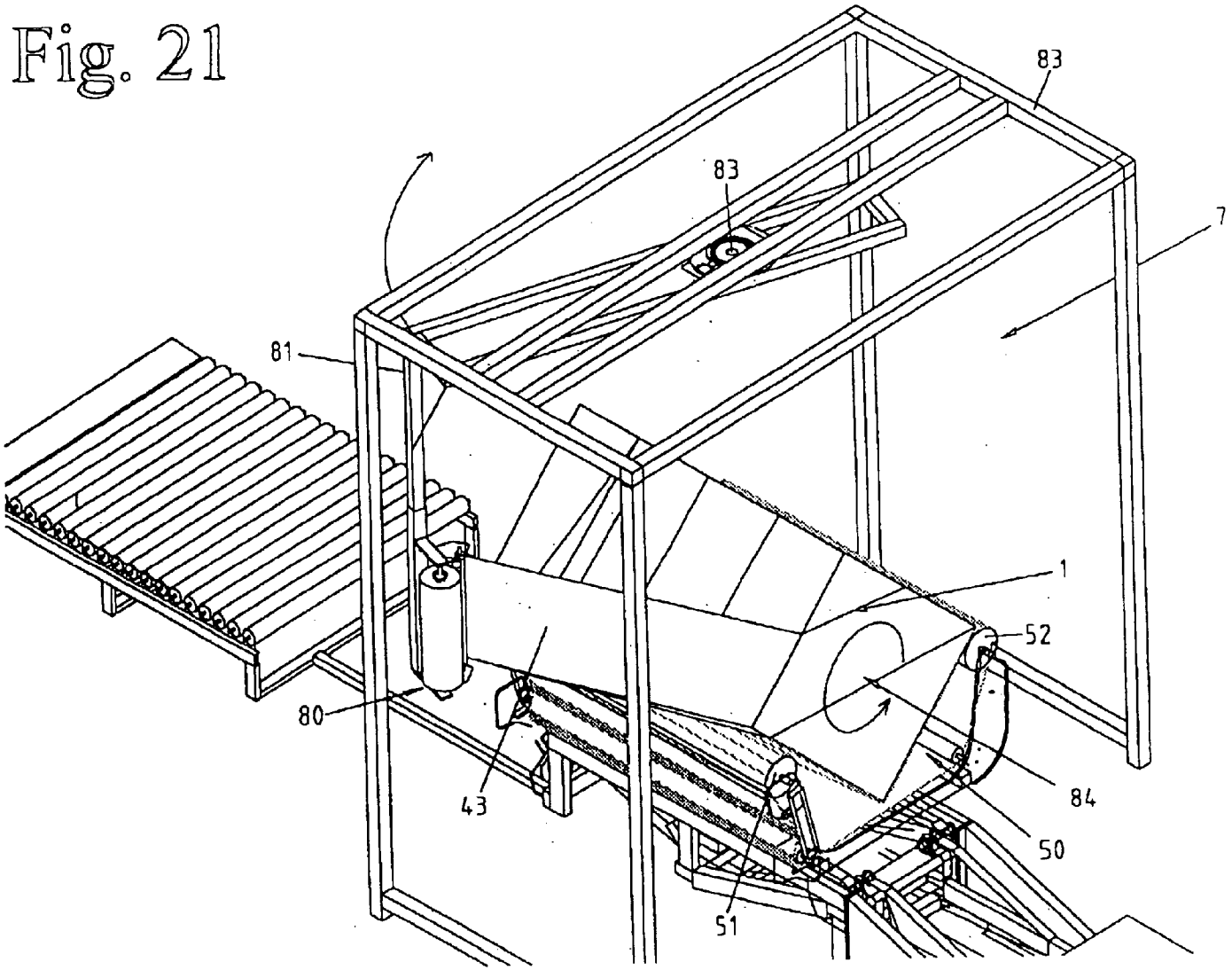
FIGS. 21 and 22 are isometric and elevational views, respectively, of a second wrapping station showing wrapping in operation.

As shown in FIG. 21, for example, the second wrapping station 7, comprises a rotary belt table 50, having two space-apart rollers 51, 52 around which an endless conveyor belt 53 travels. The belt table 50 is supported by a frame 54 (see FIG. 15), which at its forward end has two depending brackets 55 welded thereto. The brackets 55 are pivotally connected, to respective parallel beams 56.

The forward ends of the beams 56 are pivotally connected to a main pivot or fulcrum point 60 of the transfer mechanism. Likewise, the first wrapping platform assembly 20, is mounted on a pair of spaced longitudinal beams 62 (see FIG. 15), the rearward ends of which are pivotally connected, by brackets 61, to the main common fulcrum 60.

Transfer of the partly wrapped load 1 from the first wrapping station 5, to the second wrapping station 7, is achieved in four stages.

Figure 17:
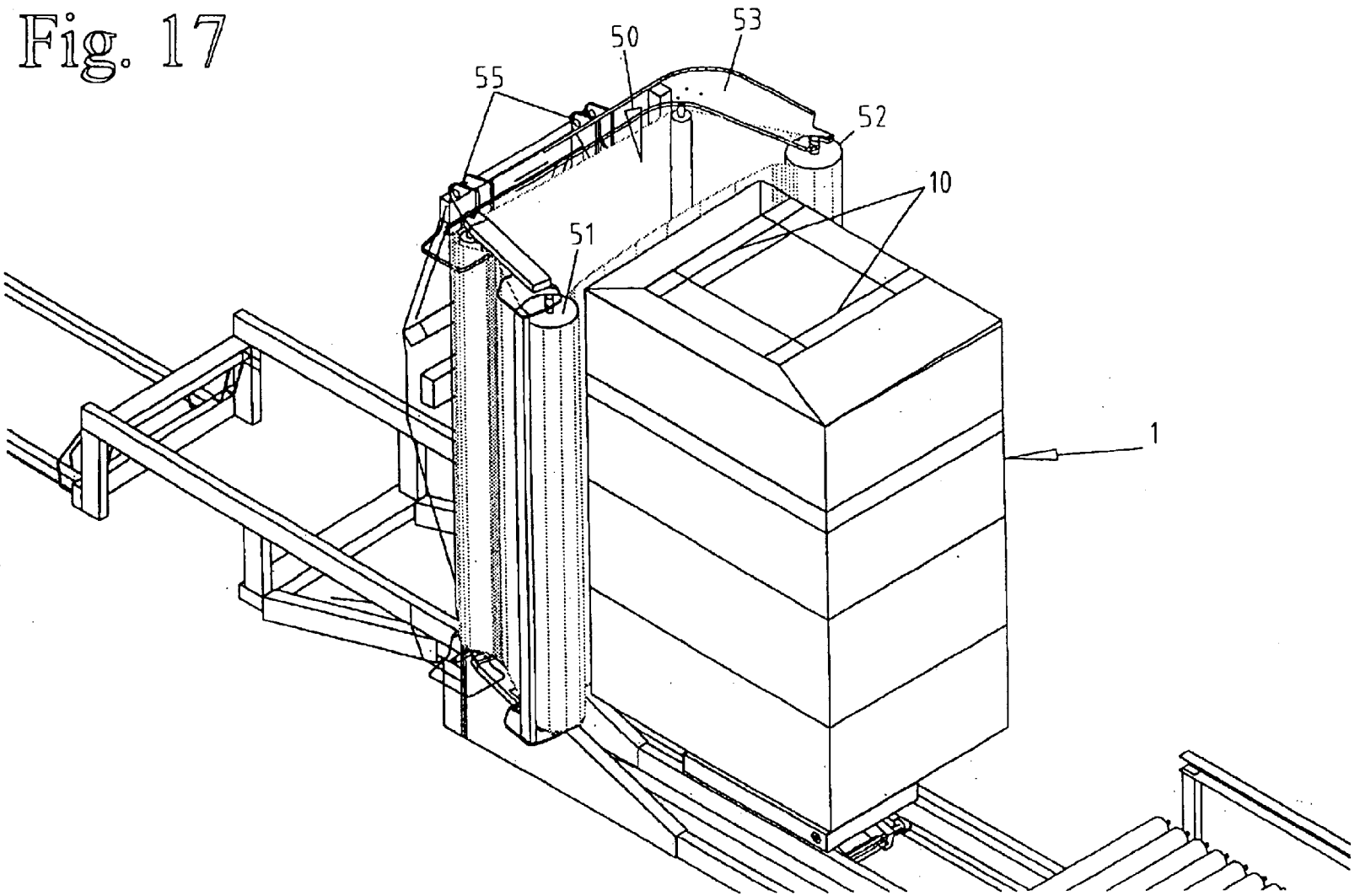
FIG. 17 is an isometric view corresponding to FIG. 16.

Firstly, the beams 56, carrying the belt table 50, are pivoted upwardly, through about 90°, by rams 70 about the main fulcrum 60, until the beams 56 and the belt table 50 are substantially vertical, as shown in FIGS. 15 to 17.

Secondly, as shown in FIG. 16, the partly wrapped load 1 is now moved towards the belt table 50, by moving the whole wrapping platform assembly 5, on wheels 24, along rails 25. This movement is effected by a transport ram 36 which can move the assembly 5 forwardly and rearwardly. This horizontal movement of the wrapping assembly, together with the vertical movement caused by the scissors mechanism 22, is important to correctly align the load 1 with the belt table 50, as described. The first wrapping assembly 5 is shown in its normal working position in FIG. 15, and in the forward position, about to engage with the transfer means 6, in FIG. 16.

At this point, the first wrapping platform assembly 20 is moved vertically and/or horizontally to accurately position the load 1 correctly at the centre of the belt table 50, between the rollers 51 (see FIG. 17). If the load 1 is positioned off-centre on the belt table 50, it can cause the belt 53 to move off the rollers 52, 52 during subsequent operation.

Figure 18:
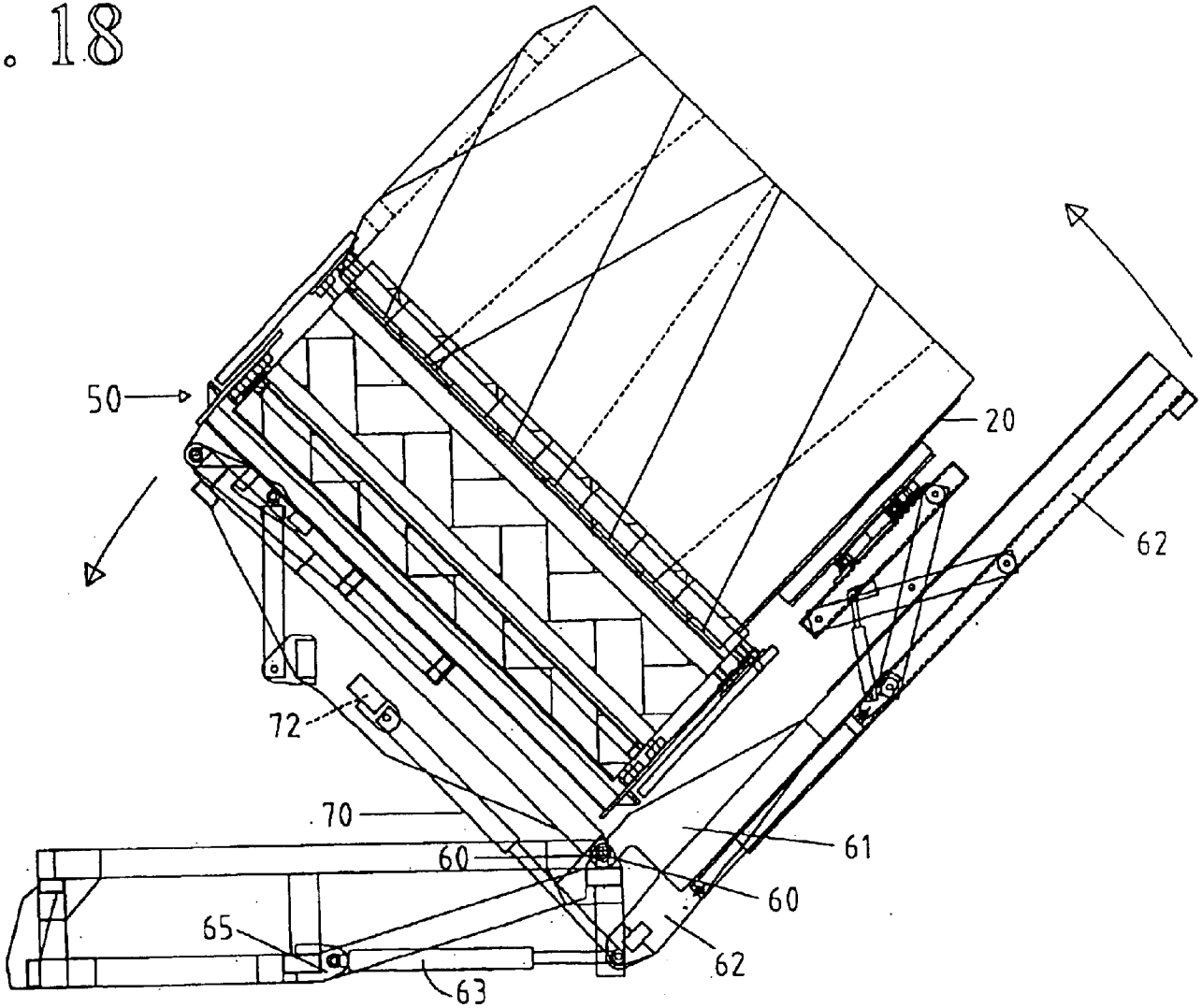
FIGS. 18, 19 and 20 arc elevational and isometric views of the third/fourth stage of transfer.
Figure 19:
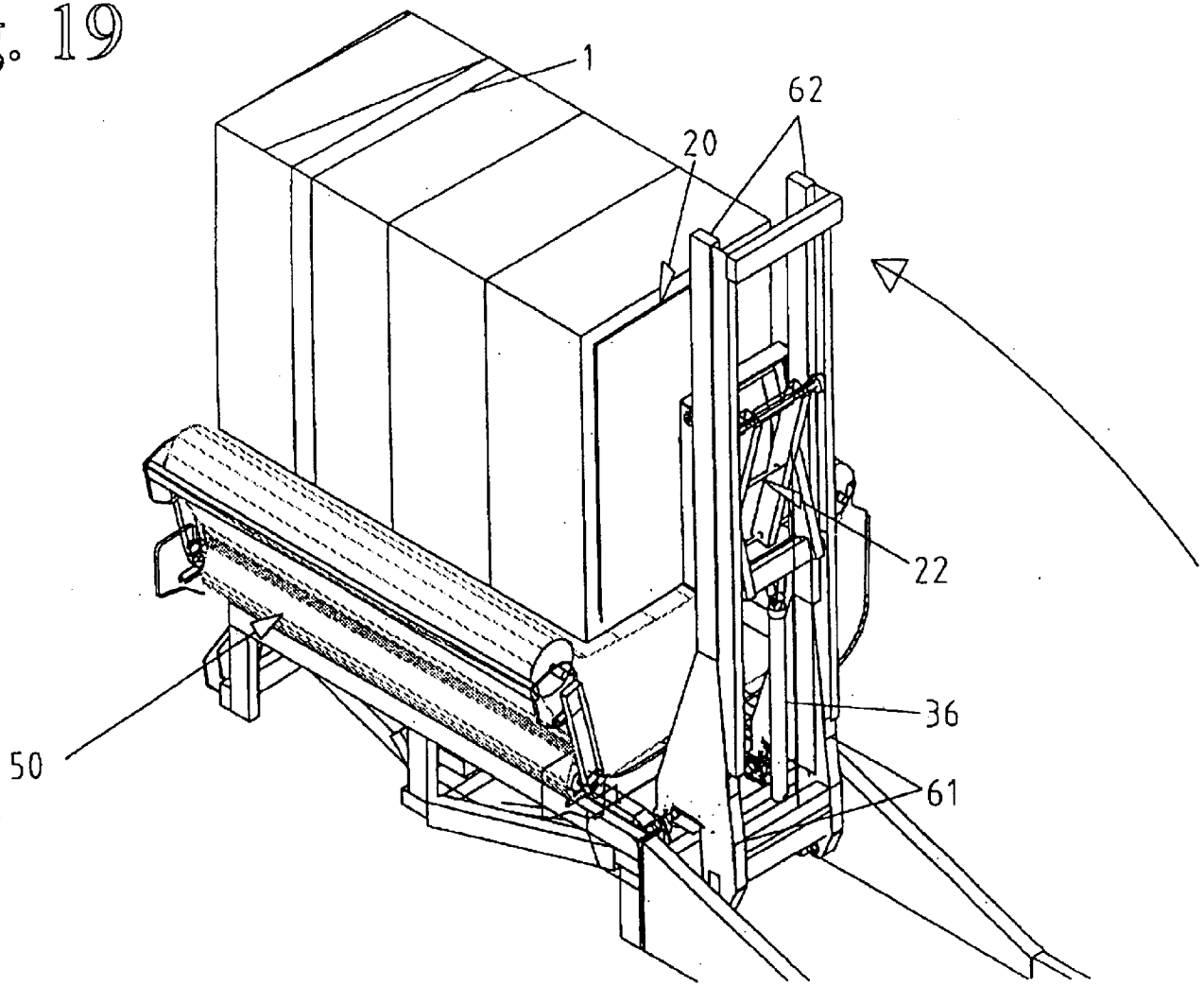

Thirdly, as shown in FIGS. 18 and 19, the beams 62, carrying the wrapping platform assembly 20 are then caused to pivot upwardly, also about the main fulcrum 60 so as to pivot the platform 20, and the load 1, through about 9020 , while simultaneously the belt table 50 is pivoted backwards, through about 9020 , to its original horizontal position (see FIG. 19). The load 1, which has been turned through 90°, now rests on the belt table 50.

Finally, the wrapping platform assembly 20, is now returned also to the horizontal position, as shown in FIG. 20.

The mechanism for achieving the transfer referred to above is now described.

The cylinder of transfer ram 70 is pivotally connected to a bracket 72 fixed to the beams 56 carrying the belt table 50 (see FIG. 15). The rod 71 of the tie ram 70 is pivotally connected to a triangular-shaped bracket 73 fixed to the beams 62 which carry the first wrapping platform 20. A second lower transfer ram has a cylinder 63 pivotally connected to a bracket 65, attached to a static support frame 89 for the belt table 50, and a rod pivotally connected to the bracket 73.

FIGS. 15 and 16 show the tie ram 70 having been extended to push the beams 56, and belt table 50, upwardly through 9020 . This is achieved by locking the lower ram 63 so that it acts as an anchor for the tie ram 70 to work against.

In FIG. 18, the lie ram 70 is shown locked, and the lower ram 63 pushes to rotate the beams 62, carrying the wrapping platform 20, upwardly about the common fulcrum point 60. This figure shows the rotation in mid-cycle, with the belt table 50 simultaneously rotating back towards the horizontal.

FIG. 19 shows the completion of the rotation of the beams 62, and wrapping platform 20 from the horizontal to the vertical position, while the belt table 20 has returned to the horizontal.

FIG. 20 shows the tie ram 70 beginning to move the first wrapping platform 20, on beams 62, back towards the horizontal, after disengagement of the wrapping platform from the bottom surface of the load 1, where the plastics wrapping has overlapped the edge of the wrapping platform 20. The lower ram 63 acts as a damper and cases the travel of the wrapping platform 20 as it returns to its original position.

After transfer of the load 1 onto the belt table 50, at the second wrapping station, the first wrapping platform 20 returns to the horizontal position, ready to receive the next load 1.

Second Wrapping Station

Figure 22:
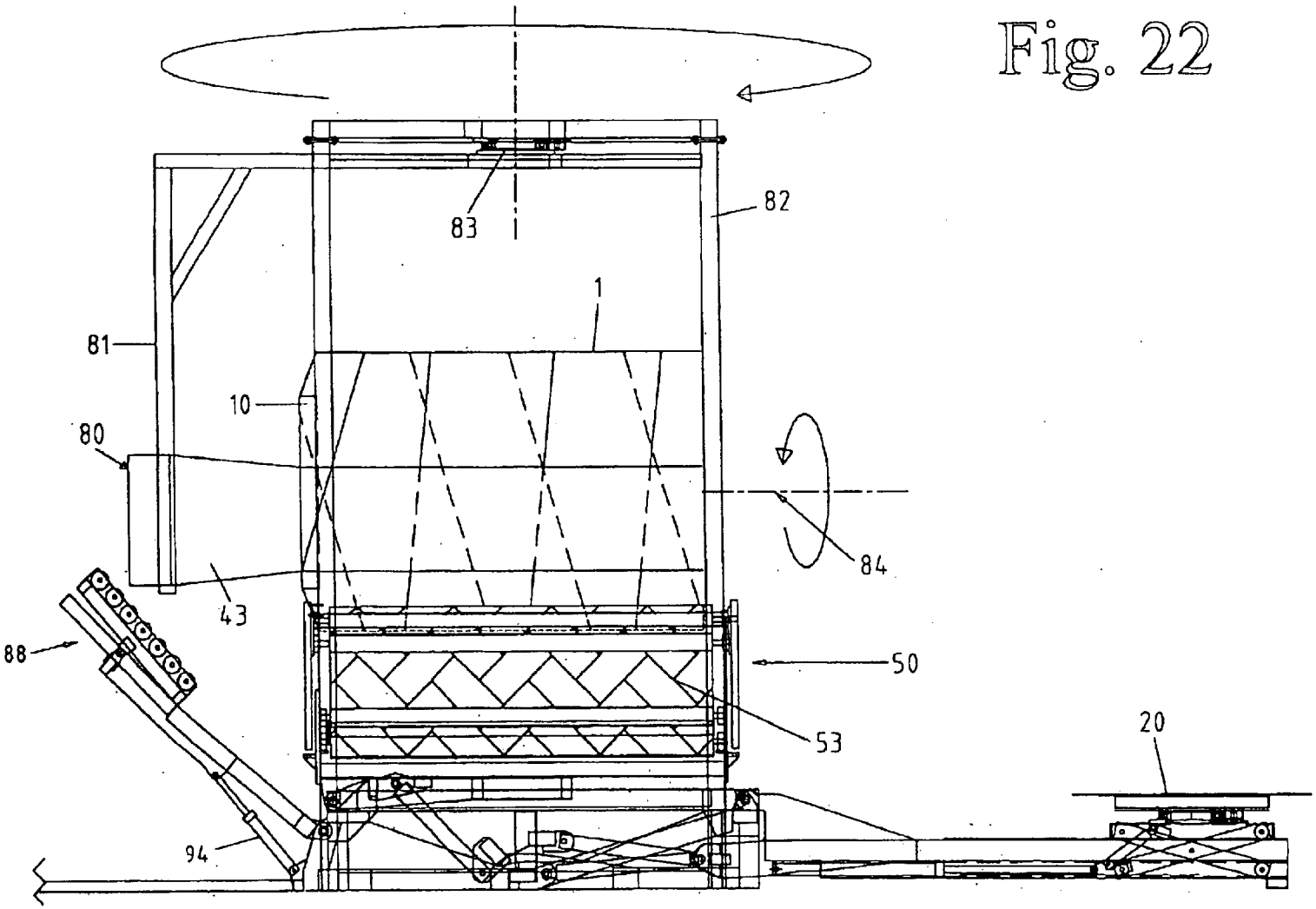

The second wrapping station is illustrated in FIGS. 21 and 22

In this embodiment of the machine the second wrapping station uses a film dispenser 80 mounted on a wrapping arm 81 which rotates about a slew ring 83. The slew ring 83 is mounted centrally above the belt table 50, on a frame 82 and is powered by a hydraulic or electric motor (not shown). The film dispenser 80 is similar to the film dispenser 40 used in the first wrapping station, and also uses a pre-tensioning stretch unit. However in this case the dispenser is fixed in position on the wrap arm 81, as it is not required to move in a vertical direction. As the wrap-arm 81 rotates, the belt 53 of the belt table 50 is turned (by a hydraulic motor driving one of the rollers 51, 52), causing the load 1 to be rotated about a horizontal axis 84. At the start of the wrapping cycle the end of the film 43 is held by the cut and start mechanism and released when the film is fully attached on the load 1. The wrapping speed is ramped up, at the start of the wrapping, and is ramped down, at the end of the wrapping, to ensure a smooth wrapping cycle. At the end of the wrapping cycle the cut and start mechanism cuts the film 43 while still holding the end attached to the dispenser 80.

The rotation of the load 1 about a horizontal axis, while wrapping around a vertical axis ensures a complete wrapping of the load 1 in plastics film, including a complete covering of the battens 10. At the second wrapping station the film 43 is applied to the load 1 in a direction which is substantially perpendicular to that applied at the first wrapping station. Thus the load 1 has been wrapped around all three axes ensuring a very effective and tight wrapping of the load 1 which also renders it water-resistant and weatherproof, and also air-tight depending upon the amount of wrapping applied.

Figure 23:
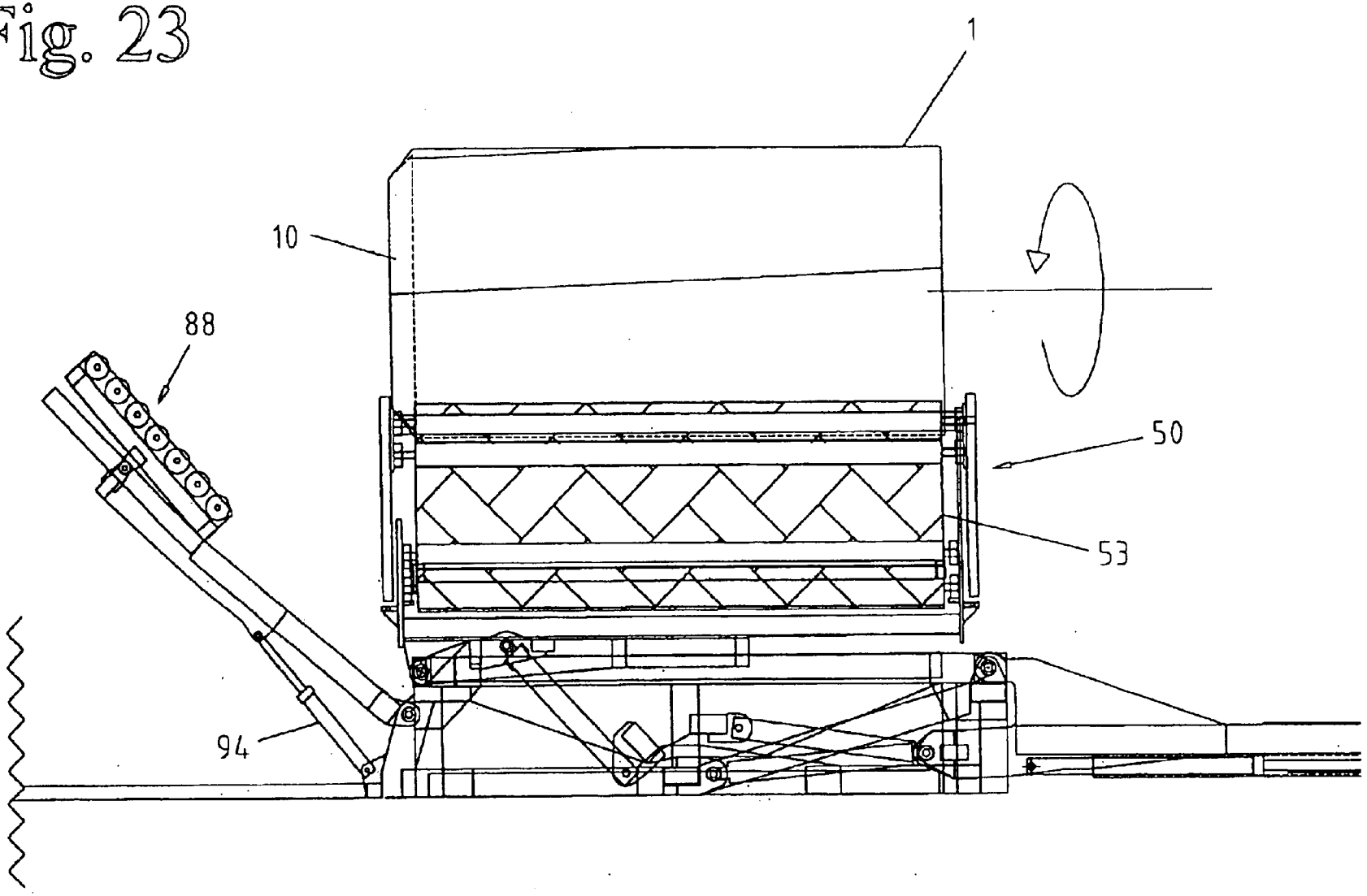
FIGS. 23 is an elevation showing the load fully wrapped end rotated to an off-load position.

When the load 1 is fully wrapped, the belt 53 is turned, independently of the wrapping arm 81, until the battens 10 are aligned in a substantially vertical direction 1.e. when the wide side of the load 1 is lying on the belt (see FIG. 23—the frame 82 and film dispenser 80 are omitted from this Figure).

Figure 24:
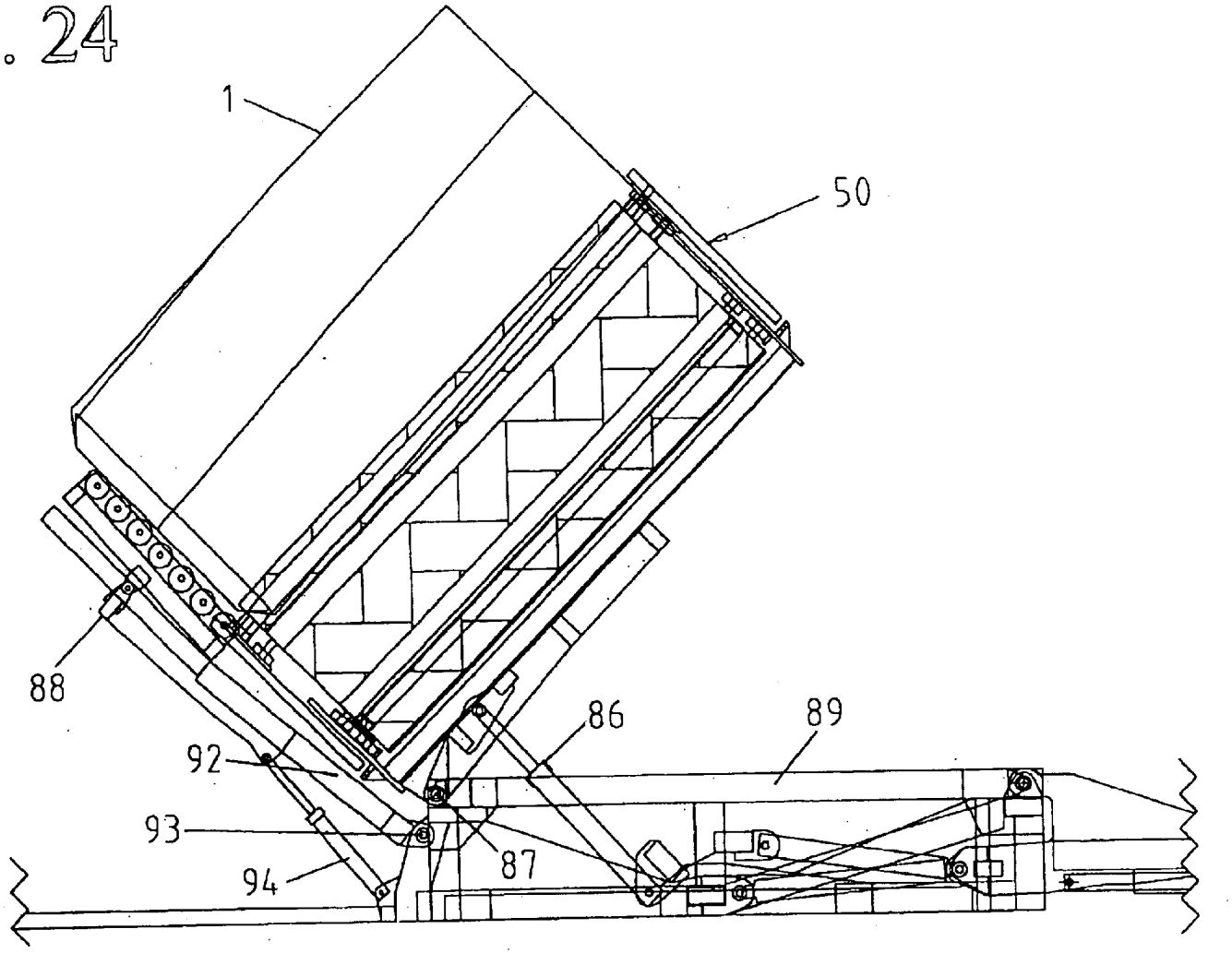
FIGS. 24, 27 and 25, 26 are elevational and isometric views showing off-loading of the wrapped load from the second wrapping station.
Figure 25:
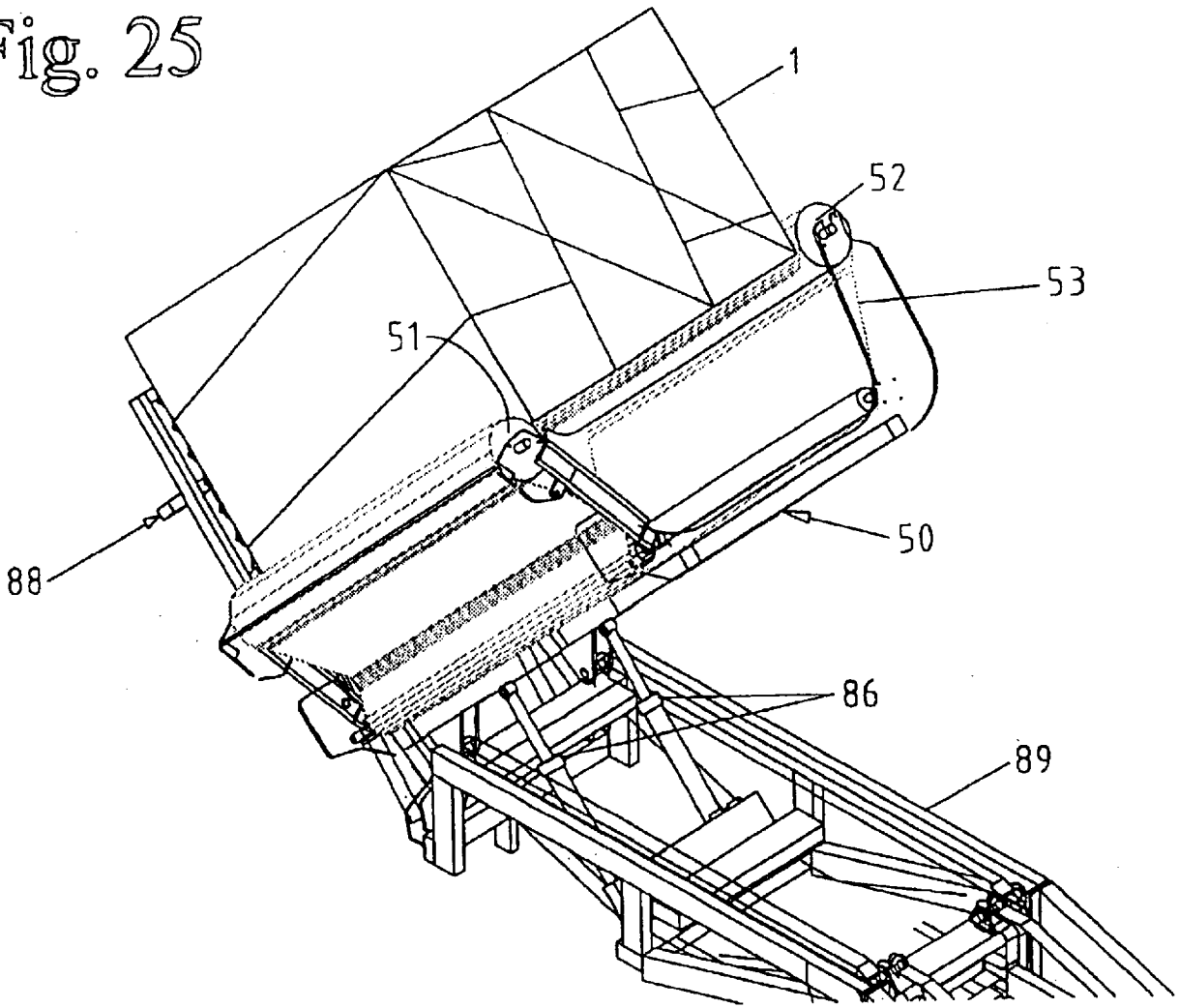
Figure 26:
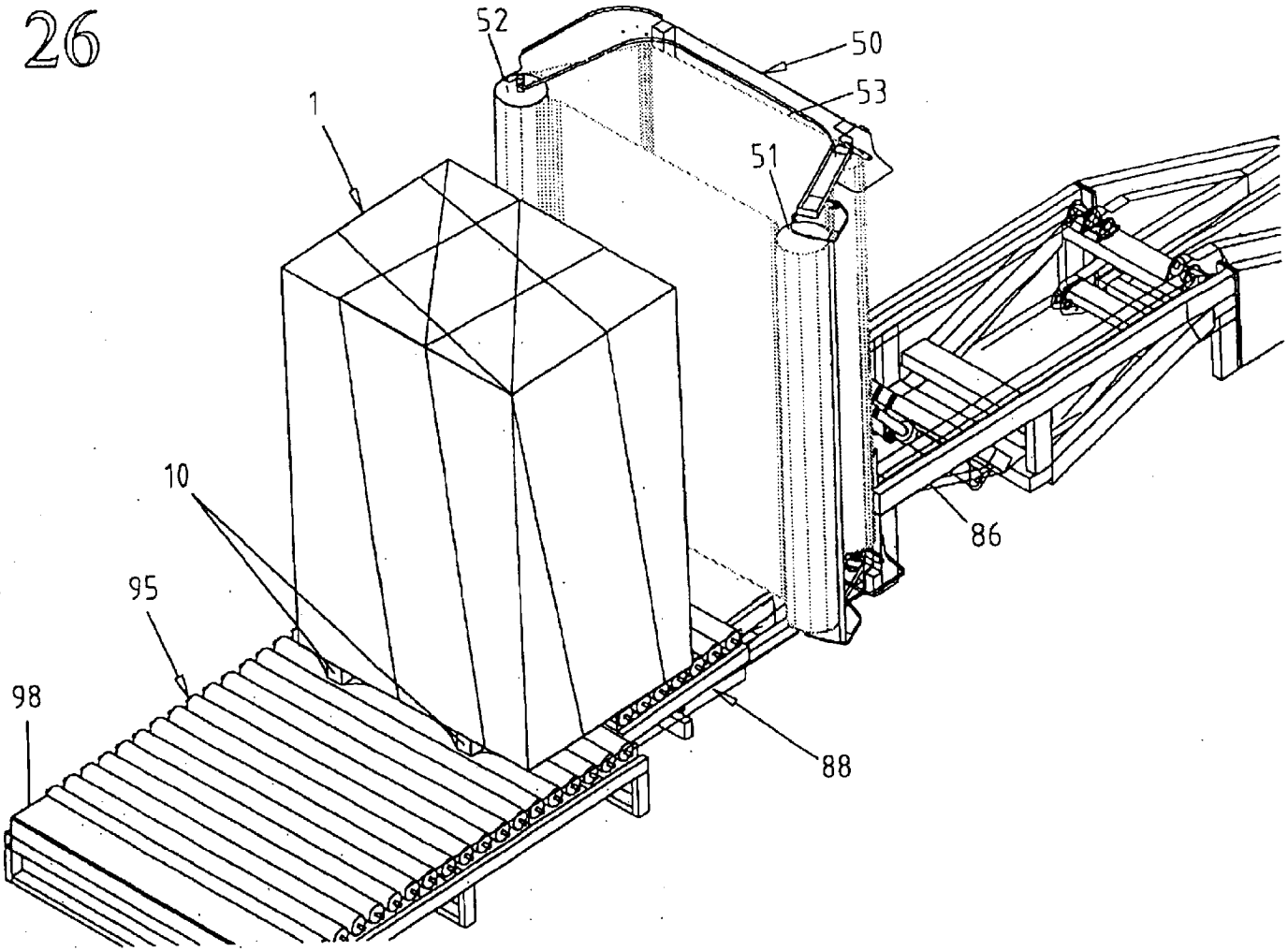
Figure 27:
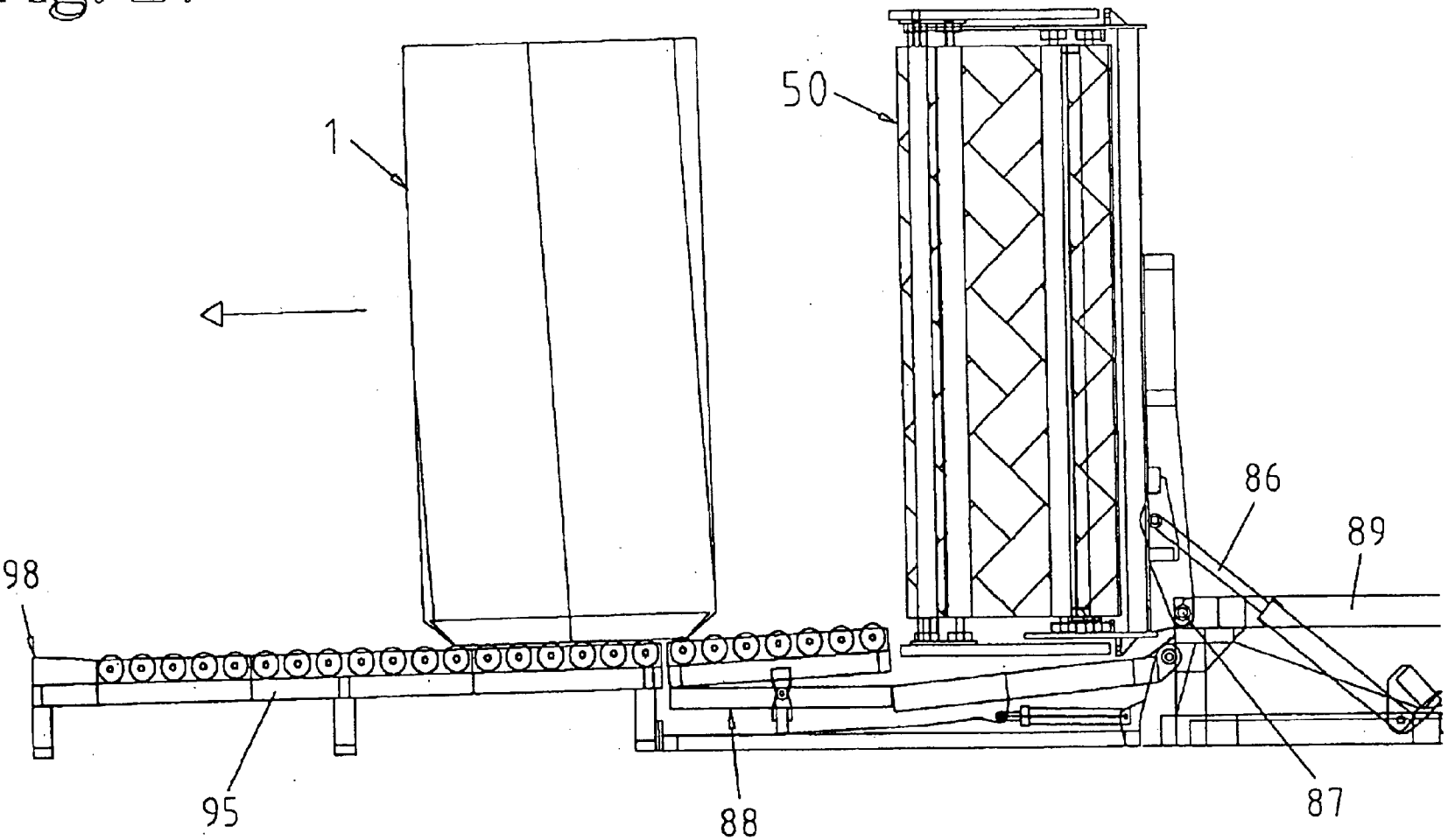
Figure 28:
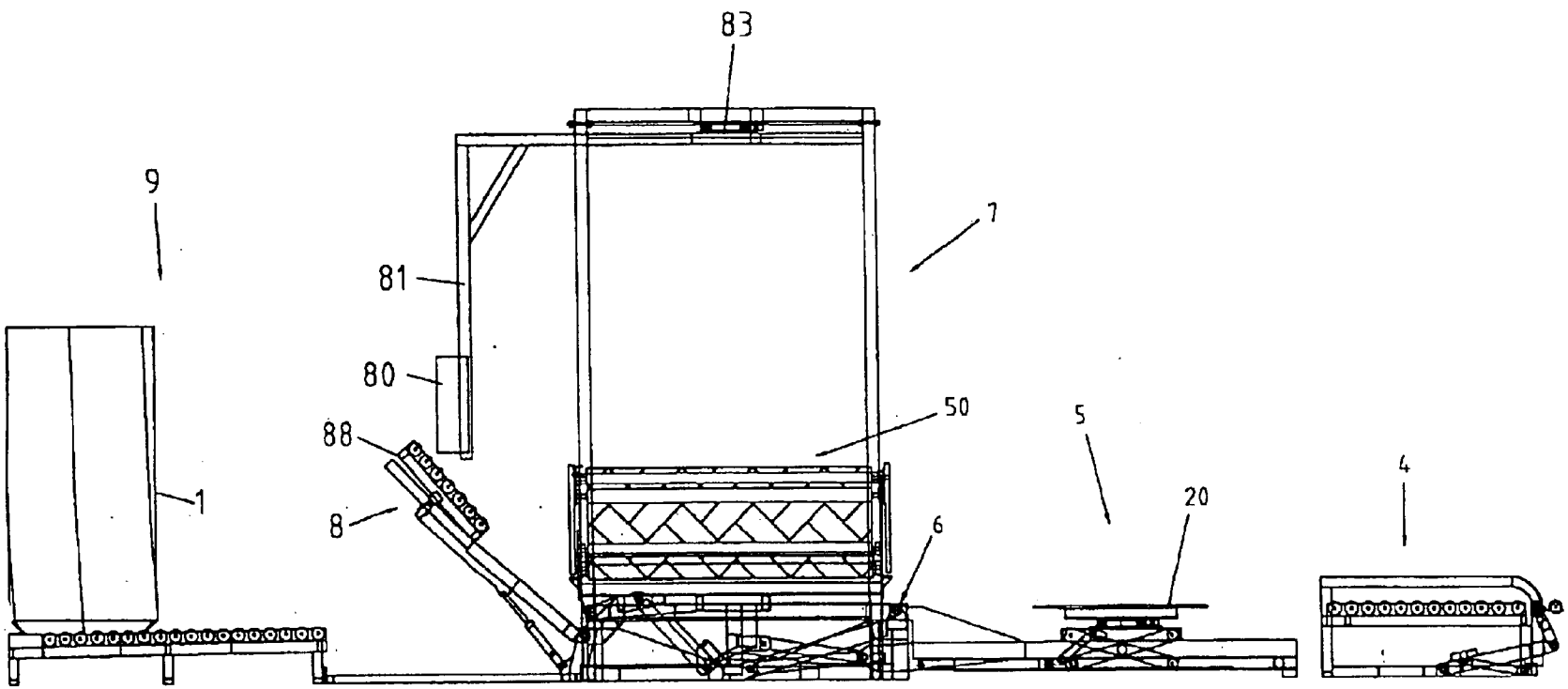
FIG. 28 is a side elevation of the overall apparatus at the end of the wrapping process.

After the second wrapping cycle is complete, the fully wrapped load 1 is tipped off the bell table 50 onto an off-loading ramp 88. Referring to FIGS. 24 and 25, this is achieved by extending tipping rams 86 to cause the belt-table 50 to rotate about a second pivot point 87 on the static support frame 89 (the belt-table 50 is pivotably mounted at both ends). As the load 1 comes into contact with the ramp 88 the weight of the load 1 pushes the ramp 88 down. The ramp 88 is mounted on arms 92 pivoted at 93 to the support 89. The downward movement and speed of the ramp 88, on arms 92, is carefully controlled by a pair of hydraulic accumulator rams 94, pivoted between the support frame 89 and the arms 92. The rams 94 are fitted with restrictors to ensure that the rate of descent of the ramp 88 is matched to the rate of descent of the tipping belt table 50. When the ramp 88 reaches its lowermost position, the belt table 50 pushes the load 1 slightly over-centre causing the ramp 88, which is pivotally mounted about its centre-point, to tilt back allowing the load 1 to roll under gravity onto an exit conveyor 95 comprised of conveyor rollers (see FIGS. 26 and 27). The load 1 travels along the conveyor 95 until either a previous load 1 on the conveyor 95, or a stop 98 at the end of the conveyors, halts it. The stop 98 consists of a box section running transversely of the end of the conveyor 95. The end of the box section 98, to the front of the machine, is located slightly below the top of the conveyor 95. The top surface of the box 98 is sloped, rising to the rear of the machine, such that as the ends of the battens 10 come in contact with the surface, forward movement of the load is stopped, while still allowing the forks of a fork-lift to enter under the load 1, between the battens 10, to remove the load 1 from the conveyor.

It will be appreciated that the wrapped load 1 has been lowered onto the ramp 88 with the battens 10 on the underside of the load 1 to facilitate subsequent handling of the load 1 by a fork lift truck or the like as described below.

Details of the battens 18 which may be used in the invention are now described with reference to FIGS. 29 to 33.

Figure 29:
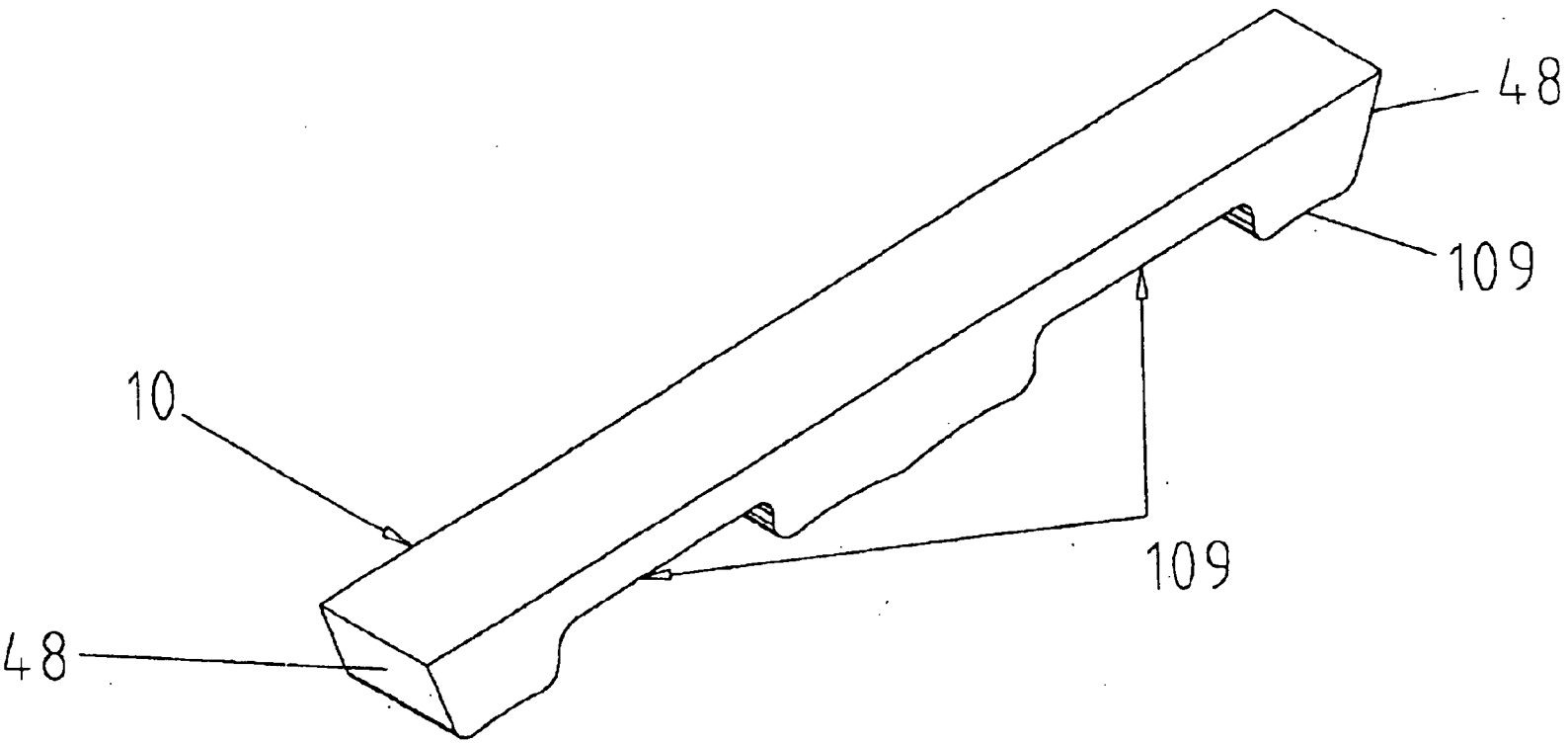
FIG. 29 is an isometric view of a four-way batten for use in the invention.

FIG. 29 shows a four-way batten 10. The batten may be made of wood or metal, or extruded from a plastics material and has an elongate shape. The top surface of the batten, which abuts the underside surface of the load 1, is planar. The bottom surface of the batten, which is intended, in use, to rest on the ground is provided with two side fork-entry openings 109. Thus, when two battens are arranged in parallel spaced-apart relationship on the underside of the load 1, as shown for example in FIG. 26, a fork lift truck operator has the option of inserting the forks from the front or rear, or between the battens from either side, that is parallel to the battens, or alternatively to insert (he forks from the side through the openings 109, that is in a direction substantially perpendicular to the battens 108. Suitably, the dimensions of the four-way batten are about 120 mm in width, 100 mm in depth, and 1100 mm in length, but may vary in dimensions depending upon the width of the load/stack to be wrapped.

Figure 30:
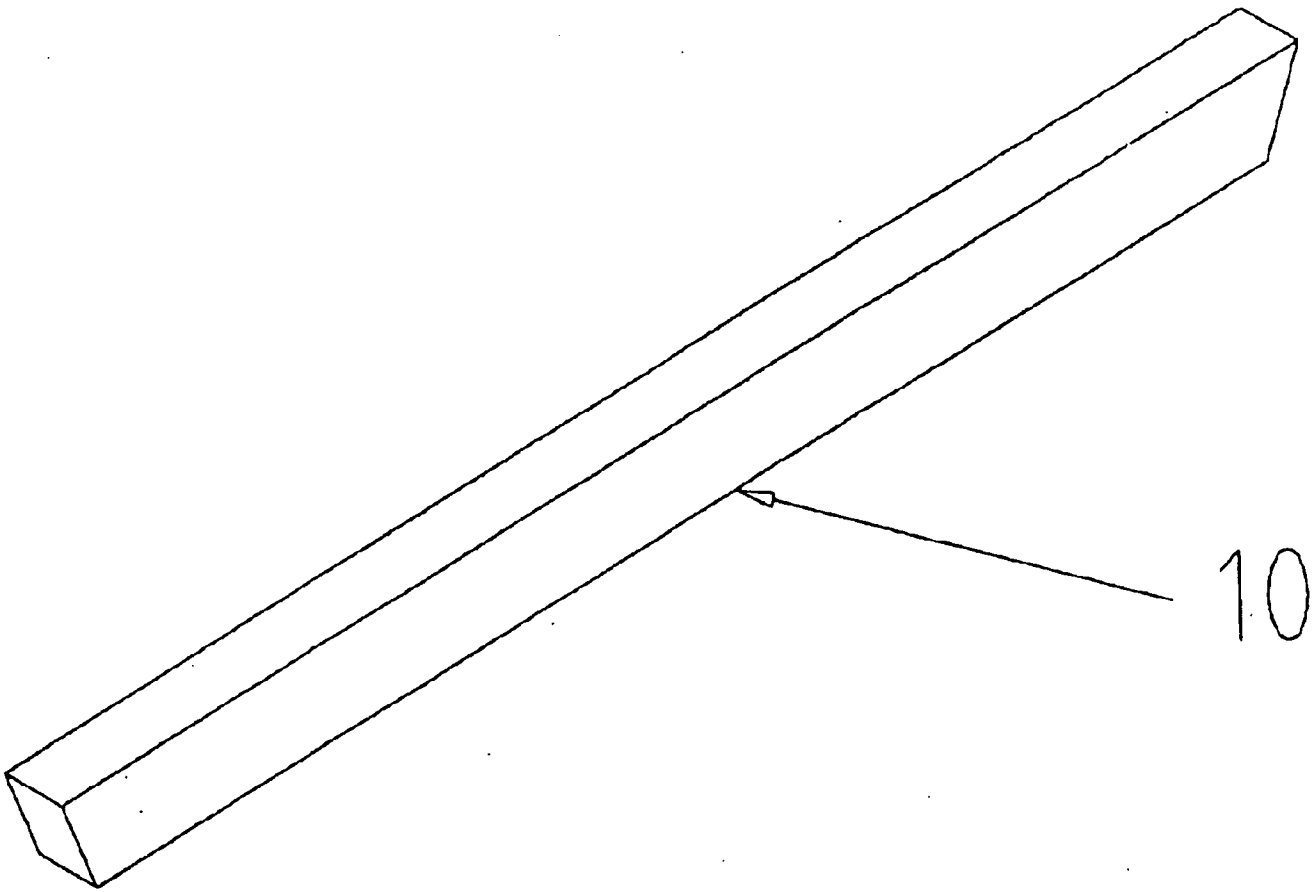
FIG. 30 is an isometric view of a two-way batten for use in the invention.

FIG. 30 shows a simple two-way batten 10, that is a batten suitable for fork entry from the front or rear of the load 1 only, but not from the side. This batten may be smaller in size than the four-way batten, typically having dimensions of about 100 mm×80 mm×1100 mm, but may vary to suit the width of the load. A similar two-way batten is shown in FIG. 33, but formed with a cut-away portion in the lower side thereof.

Figure 31:
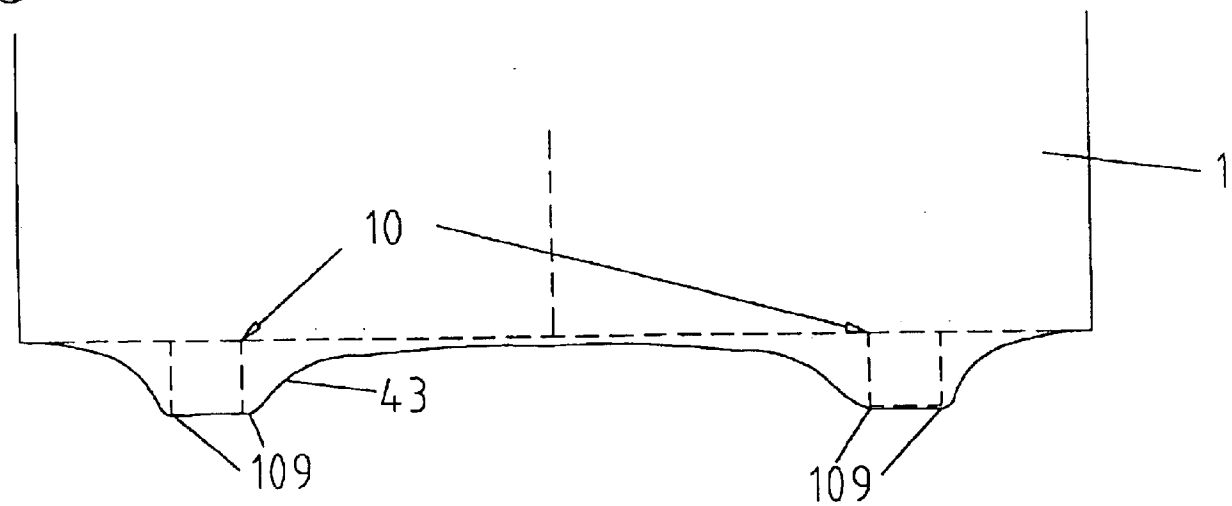
FIGS. 31 and 32 shows the battens of FIG. 30, viewed from the end and side respectively, in use.
Figure 32:
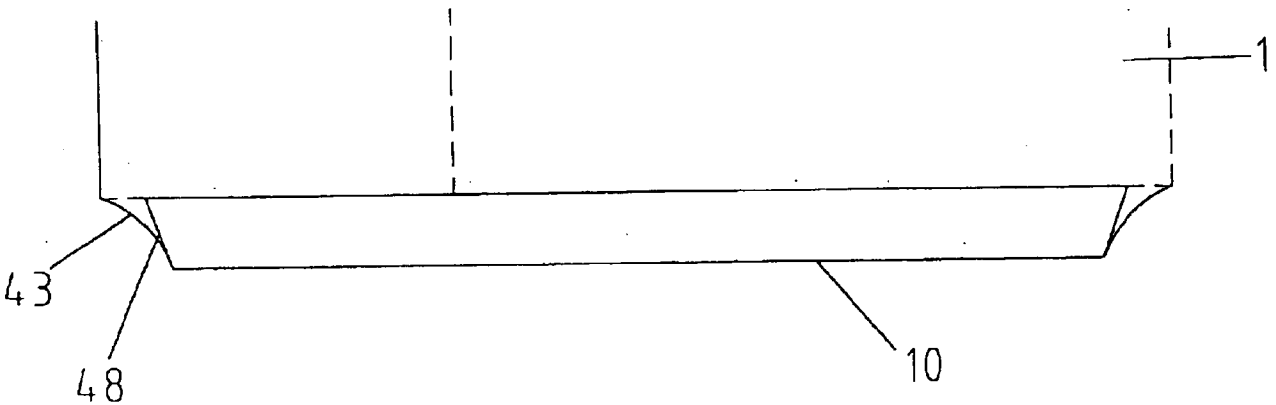

FIGS. 31 and 32 show the battens 10 in use on the underside of the load 1. In the case of the two-way batten shown in FIG. 34, it will be noted that the several layers of plastics film 43 holds the battens 10 firmly in place. The plastics film 43 shrinks itself into the openings 109 such that in use the forks of a fork lift truck may enter the openings 109 without tearing the film 43. However, because of the multilayers of film 43 used in the wrapping process the battens 10 will still be held firmly even if some of the film 43 is torn by the forks. It will be noted that the bottom profile of the batten 10 is such as to provide ridges 101. The purpose of these ridges is to reduce the contact area of the batten with the ground, so as to reduce abrasion of the film 43.

Figure 33:
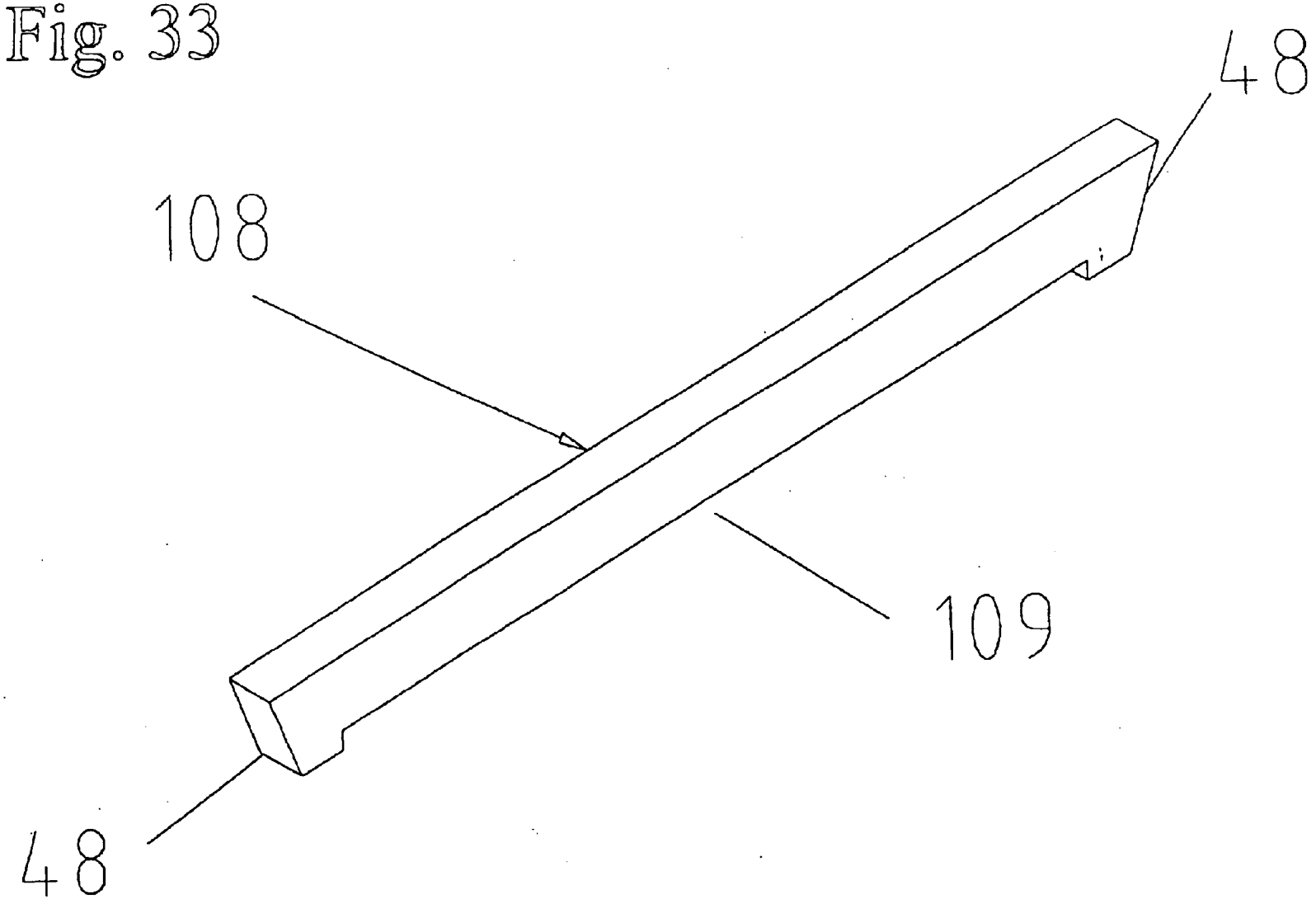
FIG. 33 is an isometric view of a further embodiment of four-way batten.

As shown in FIGS. 30, 31 and 33 the ends of the battens have inclines 48, that is the end walls may be inclined at about 70° to the horizontal. Again, this assists in reducing abrasion or tearing of the film 43 in the comer regions of the load 1.

Modifications may be made to the method and apparatus described above without departing from the scope of the invention claimed.

For example, at the first wrapping station, the embodiment described utilises two film dispensers 40 mounted on uprights 41. The use of two film dispensers reduces the wrapping cycle time. However, the two dispensers 40 could be replaced by a single film dispenser 40.

Also, at the first wrapping station the wrapping platform 20 is in the form of a rotary turntable, which rotates relative to the fixed mm dispensers 40. It would be possible to utilise a non-rotatable platform, but have the film dispensers 40 rotate around the platform 20, for example utilising an arrangement similar to that described in the second wrapping station.

Modifications may also be made to the wrapping arrangement at the second wrapping station. For example, the belt table 50 may be rotated, in well known manner, about a vertical axis relative to one or more fixed film dispensers 40.

Furthermore, at either, or both of the first and second wrapping stations, there could be contra-rotation of the wrapping platform 20 (and/or belt table 50) relative to a rotatable dispenser or dispensers 40, for example as described in PCT WO 99/64297.

The words "comprises/comprising" and the words "having/including" when used herein with reference to the present invention are used to specify the presence of stated features, integers, steps or components but does not preclude the presence or addition of one or more other features, integers, steps, components or groups thereof.

What is claimed is:

1. A method for wrapping loads (1) in a wrapping material (43) comprising the steps of.

(a) placing at least two battens (10) in a spaced, substantially parallel orientation on one surface of the load (1); and (b) at least partially wrapping the load in a wrapping material (43) such that the battens (10) are at least partially enveloped in the wrapping material (43) and held in place on the surface of the load (1), and wherein the load (1) is at least partially wrapped by establishing relative rotational motion between the load (1) and a dispensing means (40) for the wrapping material.

2. A method as claimed in claim 1 for wrapping loads (1) of goods or materials in a wrapping material, which comprises placing at least two battens (10) in a spaced substantially parallel orientation on one surface of the load (1), partially wrapping the load in a wrapping material (43) by rotating the load (1) relative to dispensing means (40) for the wrapping material (43), and/or rotating the dispensing means (40) around the load, to envelop the battens (10) in the wrapping material and to hold the battens (10) in place on the surface of the load (1), the battens (10) being placed apart to support the load (1) and being adapted to receive therebetween the forks of a fork-lift truck for transporting the load.

3. A method as claimed in any of claims 1 or 2 comprising placing the battens (10) on a top surface of the load (1), partially wrapping the load at a first wrapping station (5) with a wrapping material (43) including overlapping at least parts of the battens (10) with the wrapping material (43) to hold the battens (10) in position, turning the load through about 90° from the first wrapping station (5) to a second wrapping station (6), and completing the wrapping of the load (1) at the second wrapping station (6), including enveloping the battens (10) in the wrapping material (43).

4. A method as claimed in claim 2, wherein the wrapping material is a plastics film.

5. A method as claimed in claim 1, which comprises (a) placing at least two battens (10) on a top surface of the load (1);

(b) before or after step (a) moving the load (1) onto a wrapping platform (20) at a first wrapping station (5);

(c) rotating the wrapping platform (20) to rotate the load (1) relative to dispensing means (40) for wrapping material (43) and/or rotating the dispensing means (40) around the load (1) on the wrapping platform (20), to overlap at least part of the battens (10) to hold them in place on the load;

(d) pivoting a wrapping table (50) at a second wrapping station (7) from a substantially horizontal position to a substantially vertical position;

(e) before, after or simultaneously with step (d) moving the wrapping platform (20) with the load (1) horizontally and/or vertically to position the load (1) in a desired alignment with the wrapping table (50);

(f) returning the wrapping table (50) back from the substantially vertical position to the substantially horizontal, and simultaneously turning the wrapping platform (20) from the horizontal position towards a substantially vertical position such that the load (1) is transferred from the wrapping platform (20) onto the wrapping table (50); and (g) rotating the load (1) about a substantially horizontal axis on the wrapping table (50) and simultaneously effecting a relative rotational movement, about a substantially vertical axis, between the load (1) and at least one film dispenser (80) to completely wrap the load (1) in wrapping material (43), including enveloping the battens (10) in the wrapping material (43).

6. Apparatus for wrapping a load (1) comprising a first wrapping station (5) including a wrapping platform (20) to receive the load (1) to be wrapped, batten placing means for placing battens (10) on a surface of the load, wrapping material dispensing means (40) at the first wrapping station (5), means for establishing relative rotational motion between platform (20) and dispensing means (40), to partially wrap the load (1), including at least overlapping part of the battens (10), with the wrapping material, transfer means (6) for transferring the load, through about 90° to a second wrapping station (7), and means at the second wrapping station for completing the wrapping of the load (1).

7. Apparatus as claimed in claim 6, wherein the wrapping means at the first wrapping station includes means for rotating the platform about a vertical axis, and the wrapping means at the second wrapping station includes a belt table (50) for rotating the load (1) about a substantially horizontal axis and film dispensing means (40) for relative rotation about a substantially vertical axis to apply film to the load as it is rotated about a horizontal axis.

8. Apparatus as claimed in claim 6 or claim 7, wherein a belt table (50) at the second wrapping station (7) is pivotable from a normally horizontal position, through approximately 90°, to a position in which engages with a load (1) on the wrapping platform (20), and the wrapping platform (20) is pivotally mounted, such that as the belt table (50) is returned to its original horizontal position the wrapping platform (20) is caused to swing from a normally horizontal position, through approximately 90°, to transfer the partially wrapped load (1) onto the belt table (50) at the second wrapping station (7).

9. Apparatus as claimed in claim 8, wherein the wrapping platform (20) is moveable horizontally and vertically such that it may align a load (1) on the wrapping platform (20) with the belt table (50) when the belt table (50) is in a substantially vertical position.

10. Apparatus as claimed in claim 8, wherein the belt table (50) is pivotable about a main pivot (60) one by means of at least one transfer ram (70) from its normal horizontal position and the wrapping platform assembly (20) in also pivotable about the main pivot (60), by means of at least one transfer ram (63), through approximately 90° towards the belt table (50).

11. Apparatus as claimed in claim 10, wherein the transfer ram (70), for pivoting the belt table (50) is pivotably connected to the wrapping platform assembly (20) such that when the wrapping platform (20) is pivoted, through about 90°, by the second transfer ram (63), the belt table (50) is caused to pivot back to its original horizontal position to received the partially wrapped load (1).

12. Apparatus as claimed in claim 8, wherein the belt table (50) is pivotably mounted at opposite ends such that it may be pivoted forwardly to engage with the load (1) on the wrapping table, and subsequent to the completion of wrapping at the second wrapping station (7), may be pivoted rearwardly to off-load the wrapped load (1).

13. Apparatus as claimed in claim 6, wherein the batten placing means comprises a pick and place mechanism (3).

14. Apparatus for wrapping a load (1) comprising a first wrapping station (5) including a wrapping platform (20) to receive the load (1) to be wrapped, means for creating at least two fork-entry openings in a spaced, substantially parallel orientation on one surface of the load (1), wrapping material dispensing means (40) at the first wrapping station (5), means for establishing relative rotational motion between platform (20) and dispensing means (40), to partially wrap the load (1) with the wrapping material such that the fork-entry openings are at least partially enveloped in the wrapping material, transfer means (6) for transferring the load, through about 90° to a second wrapping station (7), and means at the second wrapping station for completing the wrapping of the load (1), including a belt table (50) for rotating the load (1) about a substantially horizontal axis and film dispensing means (40) for relative rotation about a substantially vertical axis to apply film to the load as it is rotated about a horizontal axis, wherein the belt table (50) at the second wrapping station (7) is pivotable from a normally horizontal position, through approximately 90°, to a position in which the belt table (50) engages with a load (1) on the wrapping platform (20), and the wrapping platform (20) is pivotally mounted, such that as the belt table (50) is returned to its original horizontal position the wrapping platform (20) is caused to swing from a normally horizontal position, through approximately 90°, to transfer the partially wrapped load (1) onto the belt table (50) at the second wrapping station (7), and wherein the wrapping platform (20) is moveable horizontally and vertically such that it may align a load (1) on the wrapping platform (20) with the belt table (50) when the belt table (50) is in a substantially vertical position.

15. Apparatus as claimed in claim 14, wherein the belt table (50) is pivotable about a main pivot (60) one by means of at least one transfer ram (70) from its normal horizontal position and the wrapping platform assembly (20) is also pivotable about the main pivot (60), by means of at least one transfer ram (63), through approximately 90° towards the belt table (50).

16. Apparatus as claimed in claim 15, wherein the transfer ram (70), for pivoting the belt table (50) is pivotably connected to the wrapping platform assembly (20) such that when the wrapping platform (20) is pivoted, through about 90°, by the second transfer ram (63), the belt table (50) is caused to pivot back to its original horizontal position to received the partially wrapped load (1).

17. Apparatus as claimed in claim 14, wherein the belt table (50) is pivotably mounted at opposite ends such that it may be pivoted forwardly to engage with the load (1) on the wrapping table, and subsequent to the completion of wrapping at the second wrapping station (7), may be pivoted rearwardly to off-load the wrapped load (1).

18. Apparatus as claimed in claim 14, wherein the wrapping material is a plastics film.

19. Apparatus as claimed in claim 14, comprising a wrapping material dispenser at the first wrapping station mounted for rotation about a substantially vertical axis; and a second wrapping material dispenser at the first wrapping station mounted for rotation about a substantially horizontal axis whereby a load at the first wrapping station may be partially wrapped at the first wrapping station.

20. A method for wrapping loads (1) in a wrapping material (43) comprising the steps of:

(a) creating at least two fork-entry openings in a spaced, substantially parallel orientation on one surface of the load (1) without the use of a pallet platform; and (b) at least partially wrapping the load in a wrapping material (43) such that the fork-entry openings are at least partially enveloped in the wrapping material (43) by establishing relative rotational motion between the load (1) and a dispensing means (40) for the wrapping material.

21. A method as claimed in claim 20, wherein said one surface of the load is initially a top surface of the load.

22. A method as claimed in claim 20, wherein the wrapping material is a plastics film.

23. A method as claimed in claim 20, comprising the steps of:

(a) creating at least two fork-entry openings in a spaced, substantially parallel orientation on one surface of a load;

(b) moving the load onto a wrapping platform at a first wrapping station;

(c) rotating the wrapping platform to rotate the load relative to dispensing means for wrapping material and/or rotating the dispensing means around the load on the wrapping platform, to partially wrap the load in wrapping material;

(d) transferring the partially-wrapped load from the wrapping platform onto a second wrapping table by turning the load through about 90°;

(e) rotating the load about a substantially horizontal axis on the second wrapping table and simultaneously effecting a relative rotational movement, about a substantially vertical axis, between the load and at least one film dispenser to completely wrap the load in wrapping material.

24. A method as claimed in claim 20, comprising the steps of:

(a) creating at least two fork-entry openings in a spaced, substantially parallel orientation on one surface of a load;

(b) moving the load onto a wrapping platform at a first wrapping station;

(c) rotating film dispensing means around the load about a vertical axis, and rotating film dispensing means around the load about a horizontal axis, to partially wrap the load in the wrapping material;

(d) transferring the partially-wrapped load to a second wrapping station and completing the wrapping of the load at the second wrapping station.

25. A method for wrapping loads (1) in wrapping material (43), which comprises (a) moving a load (1) onto a wrapping platform (20) at a first wrapping station (5);

(b) creating at least two fork-entry openings in a spaced, substantially parallel orientation on one surface of the load (1) without the use of a pallet platform;

(c) rotating the wrapping platform (20) to rotate the load (1) relative to dispensing means (40) for wrapping material (43) and/or rotating the dispensing means (40) around the load (1) on the wrapping platform (20), to partially wrap the load in wrapping material;

(d) pivoting a wrapping table (50) at the second wrapping station (7) from a substantially horizontal position to a substantially vertical position;

(e) before, after or simultaneously with step (a) moving the wrapping platform (20) with the load (1) horizontally and/or vertically to position the load (1) in a desired alignment with the wrapping table (50);

(f) returning the wrapping table (50) back from the substantially vertical position to the substantially horizontal, and simultaneously turning the wrapping platform (20) from the horizontal position towards a substantially vertical position such that the load (1) is transferred from the wrapping platform (20) onto the wrapping table (50); and (g) rotating the load (1) about a substantially horizontal axis on the wrapping table (50) and simultaneously effecting a relative rotational movement, about a substantially vertical axis, between the load (1) and at least one film dispenser (80) to completely wrap the load (1) in wrapping material (43).

26. A method as claimed in claim 25, wherein said one surface of the load is initially a top surface of the load.

* * * * *